US010226928B2

(12) United States Patent
Takaai et al.

(10) Patent No.: US 10,226,928 B2
(45) Date of Patent: Mar. 12, 2019

(54) SUPPRESSING INK EJECTION VARIATIONS BY ADJUSTING PRINT CONFIGURATION DATA

(71) Applicant: SEIKO EPSON CORPORATION, Tokyo (JP)

(72) Inventors: Hitoshi Takaai, Azumino (JP); Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/668,981

(22) Filed: Aug. 4, 2017

(65) Prior Publication Data

US 2018/0086079 A1 Mar. 29, 2018

(30) Foreign Application Priority Data

Sep. 28, 2016 (JP) ..... 2016-190186

(51) Int. Cl.
*B41J 2/14* (2006.01)
*B41J 2/16* (2006.01)
*B41J 2/045* (2006.01)

(52) U.S. Cl.
CPC ..... *B41J 2/1635* (2013.01); *B41J 2/04506* (2013.01); *B41J 2/04551* (2013.01); *B41J 2/04581* (2013.01); *B41J 2/14233* (2013.01); *B41J 2/161* (2013.01); *B41J 2002/14419* (2013.01); *B41J 2002/14491* (2013.01)

(58) Field of Classification Search
CPC ..... B41J 2/1635
See application file for complete search history.

(56) References Cited

U.S. PATENT DOCUMENTS 9,555,626 B1 * 1/2017 Aiba ..... B41J 2/162
2004/0008241 A1 * 1/2004 Junhua ..... B41J 2/14233 347/70
2018/0079220 A1 3/2018 Kakutani

FOREIGN PATENT DOCUMENTS

JP 2004-048985 A 2/2004
JP 2007-216576 A 8/2007
JP 2007216576 A * 8/2007

OTHER PUBLICATIONS

Notice of Allowance issued in U.S. Appl. No. 15/686,534 dated Jun. 5, 2018.

* cited by examiner

*Primary Examiner* — Bradley W Thies
(74) *Attorney, Agent, or Firm* — Workman Nydegger

(57) ABSTRACT

Provided is a method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method including measuring natural frequencies of the plurality of segments included in each of the chips, classifying the chips into ranks using the mode value of the natural frequencies of the chips as a reference, and manufacturing the liquid ejecting head which includes the chips selected based on the ranks.

9 Claims, 15 Drawing Sheets

DOT GENERATION TABLE OF SEGMENT #1

DOT GENERATION TABLE OF SEGMENT #20

DOT GENERATION TABLE OF SEGMENT #70

FREQUENCY DISTRIBUTION OF NATURAL FREQUENCY OF CHIP #1

FREQUENCY DISTRIBUTION OF NATURAL FREQUENCY OF CHIP #2

FREQUENCY DISTRIBUTION OF NATURAL FREQUENCY OF CHIPS #1 AND #2

FREQUENCY DISTRIBUTION OF NATURAL FREQUENCY OF CHIP #1

FREQUENCY DISTRIBUTION OF NATURAL FREQUENCY OF CHIP #2

FREQUENCY DISTRIBUTION OF NATURAL FREQUENCY OF CHIPS #1 AND #2

DOT GENERATION TABLE OF SEGMENT #1

DOT GENERATION TABLE OF SEGMENT #20

DOT GENERATION TABLE OF SEGMENT #70

SUPPRESSING INK EJECTION VARIATIONS BY ADJUSTING PRINT CONFIGURATION DATA

The entire disclosure of Japanese Patent Application No. 2016-190186, filed Sep. 28, 2016 is expressly incorporated by reference herein.

BACKGROUND

1. Technical Field

The present invention relates to a method for manufacturing a liquid ejecting head and a liquid ejecting head, and particularly to a method for manufacturing an ink jet recording head, which ejects ink as liquid, and an ink jet recording head.

2. Related Art

As a typical example of a liquid ejecting head unit, for example, an ink jet recording head which includes a plurality of chips, each of which includes a pressure generating chamber communicating with a nozzle opening, a diaphragm which is a portion of the pressure generating chamber, and a piezoelectric element causing a pressure change in the pressure generating chamber through the diaphragm, is known.

The ink jet recording head is manufactured by using chips having the same or similar ink ejection characteristics (for example, see JP-A-2004-48985). Specifically, an electrostatic capacitance of a piezoelectric layer which is a piezoelectric element of a chip and a resonance frequency of the piezoelectric element are measured to classify the chips into ranks based on the electrostatic capacitance and the resonance frequency. The ink jet recording head is manufactured using the chips having the same rank. With this, the same driving waveform is supplied to the piezoelectric element of each chip so as to make it possible to eject ink with the same ink ejection characteristics and to extensively improve printing quality.

However, in the JP-A-2004-48985, although matters that the chips are ranked based on the electrostatic capacitance and the resonance frequency are disclosed, a specific rank classification method is not disclosed, and matters how to rank the chips by using which numerical value and which method and manufacture the ink jet recording head are not disclosed. In recent years, an ink jet recording head including a plurality of chips having smaller variation in the ink ejection characteristics is demanded.

Such a situation exists similarly not only in the ink jet recording head and the manufacturing method thereof but also in a liquid ejecting head ejecting liquid other than ink and a manufacturing method thereof.

SUMMARY

An advantage of some aspects of the invention is to provide a liquid ejecting head including a plurality of chips in which variation in the ejection characteristics of liquid is suppressed and a manufacturing method thereof.

According to an aspect of the invention, there is provided a method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method including: measuring natural frequencies of the plurality of segments included in each of the chips; classifying the chips into ranks using the mode value of the natural frequencies of the chips as a reference; and manufacturing the liquid ejecting head which includes the chips selected based on the ranks.

According to the aspect, it is possible to manufacture a liquid ejecting head including a plurality of chips in which variation in the ejection characteristics of liquid of respective segments is suppressed.

Print data to be printed by the liquid ejecting head is converted into data represented by a dot generation ratio according to a dot generation amount table. The dot generation amount table is defined for each segment. According to the invention, the dot generation amount table is corrected only for a segment of which a natural frequency is smaller than or larger than the mode value so as to make it possible to suppress variation in an ejection amount of liquid caused by variation in the natural frequency of each segment. Since it is possible to reduce the number of segments which become targets for correction, it is possible to more efficiently manufacture a liquid ejecting head including a plurality of chips.

Since it is possible to reduce the number of segments which become targets for correction of a dot generation amount table, it is possible to reduce the computation time for image processing using the dot generation amount table.

Furthermore, correction of the dot generation amount table is performed for the segment of which the natural frequency is smaller than or larger than the mode value, based on the difference between the natural frequency of the segment and the mode value of the natural frequency. That is, it is possible to correct the dot generation amount table without ejecting liquid from the liquid ejecting head.

A range of the natural frequencies is preferably defined for each rank to classify the chips into a rank corresponding to the range. Thus, it is possible to classify the chips having mode values of the natural frequencies which approximate each other into the same rank.

The range of the natural frequencies is preferably set to a range that divisions of which the number is greater than or equal to 10 and less than or equal to 50 are made between the minimum value and the maximum value of the mode value of the natural frequencies. Thus, it is possible to classify the chips having mode values of the natural frequencies which approximate each other into the same rank.

The range of the natural frequencies is preferably defined so that a weight of liquid ejected from each segment of the chip equals to an amount within ±5%. Variation in the liquid weights is suppressed so as to make it possible to classify the chips having the same ejection characteristic of liquid into the same rank.

According to still another aspect of the invention, there is provided a method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method including: measuring a weight of liquid ejected from each of the plurality of segments included in each of the chips; classifying the chips into ranks using the mode value of the weight of liquid as a reference; and manufacturing the liquid ejecting head which includes the chips selected based on the ranks.

According to the aspect, it is possible to manufacture a liquid ejecting head including a plurality of chips in which variation in the ejection characteristics of liquid of respective segments is suppressed.

Print data to be printed by the liquid ejecting head is converted into data represented by a dot generation ratio according to a dot generation amount table. The dot generation amount table is defined for each segment. According to the invention, the dot generation amount table is corrected only for a segment of which a weight of liquid is smaller than or larger than the mode value so as to make it possible to suppress variation in an ejection amount of liquid. Since it is possible to reduce the number of segments which become targets for correction, it is possible to more efficiently manufacture a liquid ejecting head including a plurality of chips.

Since it is possible to reduce the number of segments which become targets for correction of the dot generation amount table, it is possible to reduce the computation time for image processing using the dot generation amount table.

According to still another aspect of the invention, there is provided a method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method including: measuring displacement amounts of the diaphragms of the plurality of segments included in each of the chips; classifying the chips into ranks using the mode value of the displacement amounts as a reference; and manufacturing the liquid ejecting head which includes the chips selected based on the ranks.

According to the aspect, it is possible to manufacture a liquid ejecting head including a plurality of chips in which variation in the ejection characteristics of liquid of respective segments is suppressed.

Print data to be printed by the liquid ejecting head is converted into data represented by a dot generation ratio according to a dot generation amount table. The dot generation amount table is defined for each segment. According to the invention, the dot generation amount table is corrected only for a segment of which a displacement amount is smaller than or larger than the mode value of the displacement amount of the diaphragm so as to make it possible to suppress variation in an ejection amount of liquid caused by variation in the displacement amount of each segment. Since it is possible to reduce the number of segments which become targets for correction, it is possible to more efficiently manufacture a liquid ejecting head including a plurality of chips.

Since it is possible to reduce the number of segments which become targets for correction of a dot generation amount table, it is possible to reduce the computation time relating to image processing using the dot generation amount table.

Furthermore, correction of the dot generation amount table is performed for the segment of which the displacement amount is smaller than or larger than the mode value, based on the difference between the displacement amount of the segment and the mode value of the displacement amount. That is, it is possible to correct the dot generation amount table without ejecting liquid from the liquid ejecting head.

According to another aspect of the invention, there is provided a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm. The liquid ejecting head satisfies the following expression.

$$\sum_{i=1}^{n}(\text{fa_mode_i} - \text{fa_mode_ave})^2 < \sum_{i=1}^{n}(\text{fa_ave_i} - \text{fa_ave_ave})^2$$

$$\sum_{i=1}^{n}(\text{fa_mode_i} - \text{fa_mode_ave})^2 < \sum_{i=1}^{n}(\text{fa_max_i} - \text{fa_max_ave})^2$$

$$\sum_{i=1}^{n}(\text{fa_mode_i} - \text{fa_mode_ave})^2 < \sum_{i=1}^{n}(\text{fa_min_i} - \text{fa_min_ave})^2$$

$$\sum_{i=1}^{n}(\text{fa_mode_i} - \text{fa_mode_ave})^2 < \sum_{i=1}^{n}(\text{fa_med_i} - \text{fa_med_ave})^2$$

$$\text{fa_mode_ave} = \left(\sum_{i=1}^{n}\text{fa_mode_i}\right)\Big/ n$$

$$\text{fa_ave_ave} = \left(\sum_{i=1}^{n}\text{fa_ave_i}\right)\Big/ n$$

$$\text{fa_max_ave} = \left(\sum_{i=1}^{n}\text{fa_max_i}\right)\Big/ n$$

$$\text{fa_min_ave} = \left(\sum_{i=1}^{n}\text{fa_min_i}\right)\Big/ n$$

$$\text{fa_med_ave} = \left(\sum_{i=1}^{n}\text{fa_med_i}\right)\Big/ n$$

Here, i is an integer from 1 to n, n is the number of chips included in the liquid ejecting head, and fa_mode_i, fa_ave_i, fa_max_i, fa_min_i, and fa_med_i correspond to the mode value, the average value, the maximum value, the minimum value, and the median value of the natural frequencies of the plurality of segments included in an i-th chip.

According to the aspect, in the liquid ejecting head, variation in the mode value of the natural frequencies of all chips is smaller than variation in the average value, the maximum value, the minimum value, and the median value of the natural frequencies of all chips. It is possible to suppress variation in the ejection characteristics of liquid of each segment in the liquid ejecting head and to perform high-quality printing by the liquid ejecting head.

According to still another aspect of the invention, there is provided a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm. The liquid ejecting head satisfies the following expression.

$$\sum_{i=1}^{n}(\text{Iw_mode_i}-\text{Iw_mode_ave})^2<\sum_{i=1}^{n}(\text{Iw_ave_i}-\text{Iw_ave_ave})^2$$

$$\sum_{i=1}^{n}(\text{Iw_mode_i}-\text{Iw_mode_ave})^2<\sum_{i=1}^{n}(\text{Iw_max_i}-\text{Iw_max_ave})^2$$

$$\sum_{i=1}^{n}(\text{Iw_mode_i}-\text{Iw_mode_ave})^2<\sum_{i=1}^{n}(\text{Iw_min_i}-\text{Iw_min_ave})^2$$

$$\sum_{i=1}^{n}(\text{Iw_mode_i}-\text{Iw_mode_ave})^2<\sum_{i=1}^{n}(\text{Iw_med_i}-\text{Iw_med_ave})^2$$

$$\text{Iw_mode_ave}=\left(\sum_{i=1}^{n}\text{Iw_mode_i}\right)\Big/n$$

$$\text{Iw_ave_ave}=\left(\sum_{i=1}^{n}\text{Iw_ave_i}\right)\Big/n$$

$$\text{Iw_max_ave}=\left(\sum_{i=1}^{n}\text{Iw_max_i}\right)\Big/n$$

$$\text{Iw_min_ave}=\left(\sum_{i=1}^{n}\text{Iw_min_i}\right)\Big/n$$

$$\text{Iw_med_ave}=\left(\sum_{i=1}^{n}\text{Iw_med_i}\right)\Big/n$$

Here, i is an integer from 1 to n, n is the number of chips included in the liquid ejecting head, and Iw_mode_i, Iw_ave_i, Iw_max_i, Iw_min_i, and Iw_med_i correspond to the mode value, the average value, the maximum value, the minimum value, and the median value of the weights of liquid ejected from each of the plurality of segments included in an i-th chip.

According to the aspect, in the liquid ejecting head, variation in the median value of the weights of liquid of all chips is smaller than variation in the average value, the maximum value, the minimum value, and the median value of the weights of liquid of all chips. It is possible to suppress variation in the ejection characteristics of liquid of each segment in the liquid ejecting head and to perform high-quality printing by the liquid ejecting head.

According to still another aspect of the invention, there is provided a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm. The liquid ejecting head satisfies the following expression.

$$\sum_{i=1}^{n}(\text{D_mode_i}-\text{D_mode_ave})^2<\sum_{i=1}^{n}(\text{D_ave_i}-\text{D_ave_ave})^2$$

$$\sum_{i=1}^{n}(\text{D_mode_i}-\text{D_mode_ave})^2<\sum_{i=1}^{n}(\text{D_max_i}-\text{D_max_ave})^2$$

$$\sum_{i=1}^{n}(\text{D_mode_i}-\text{D_mode_ave})^2<\sum_{i=1}^{n}(\text{D_min_i}-\text{D_min_ave})^2$$

$$\sum_{i=1}^{n}(\text{D_mode_i}-\text{D_mode_ave})^2<\sum_{i=1}^{n}(\text{D_med_i}-\text{D_med_ave})^2$$

-continued $$\text{D_mode_ave}=\left(\sum_{i=1}^{n}\text{D_mode_i}\right)\Big/n$$

$$\text{D_ave_ave}=\left(\sum_{i=1}^{n}\text{D_ave_i}\right)\Big/n$$

$$\text{D_max_ave}=\left(\sum_{i=1}^{n}\text{D_max_i}\right)\Big/n$$

$$\text{D_min_ave}=\left(\sum_{i=1}^{n}\text{D_min_i}\right)\Big/n$$

$$\text{D_med_ave}=\left(\sum_{i=1}^{n}\text{D_med_i}\right)\Big/n$$

Here, i is an integer from 1 to n, n is the number of chips included in the liquid ejecting head, and D_mode_i D_ave_i, D_max_i, D_min_i, and D_med_i correspond to the mode value, the average value, the maximum value, the minimum value, and the median value of displacement amounts of the diaphragms of the plurality of segments included in an i-th chip.

According to the aspect, in the liquid ejecting head, variation in the mode value of the displacement amounts of all chips is smaller than variation in the average value, the maximum value, the minimum value, and the median value of the displacement amounts of all chips. It is possible to suppress variation in the ejection characteristics of liquid of each segment in the liquid ejecting head and to perform high-quality printing by the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

One embodiment of the invention will be described in detail. In the present embodiment, as an example of a liquid ejecting head, an ink jet recording head (in the following, simply referred to as a recording head) discharging ink will be described. Also, as an example of a liquid ejecting apparatus, an ink jet recording apparatus including a head will be described.

Figure 1:
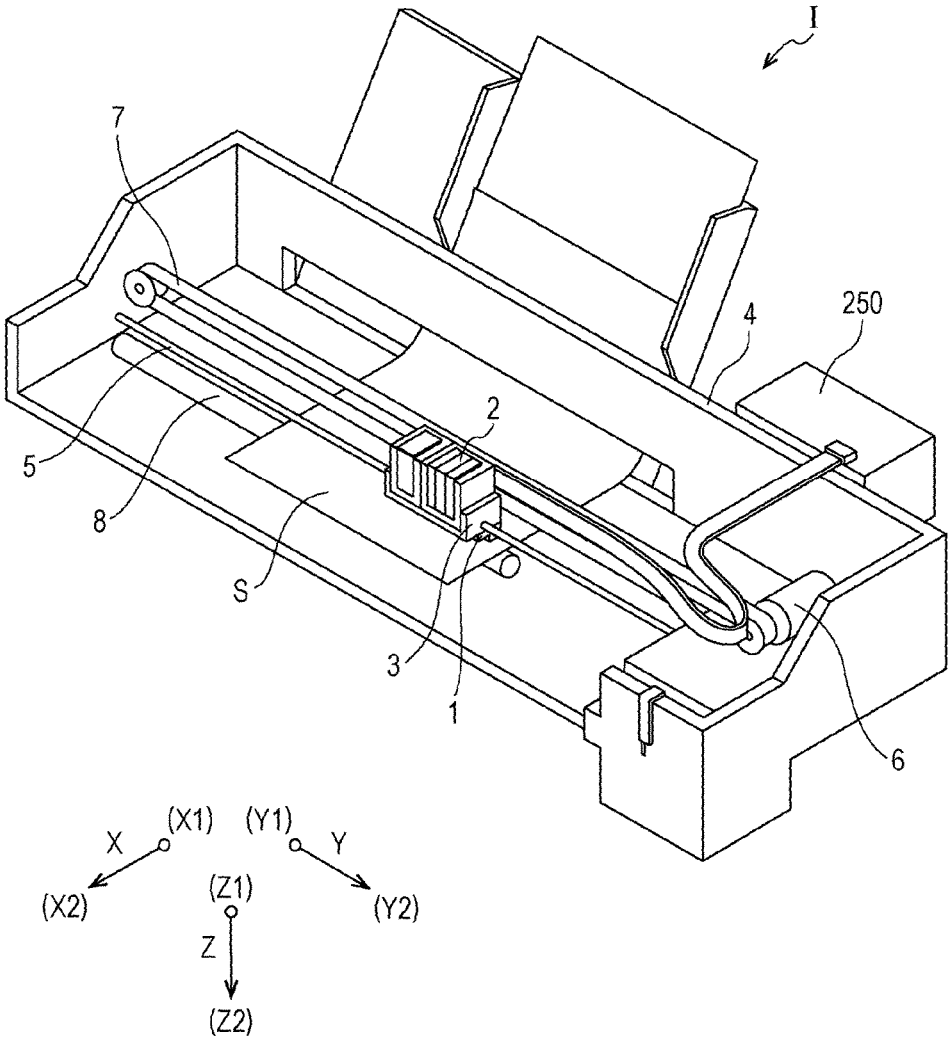
FIG. 1 is a perspective view of a schematic configuration of an ink jet recording apparatus according to Embodiment 1.

FIG. 1 is a perspective view of a schematic configuration of an ink jet recording apparatus according to the present embodiment. An ink jet recording apparatus I includes a recording head 1 ejecting ink, which is an example of liquid, in ink droplets. The recording head 1 is mounted on a carriage 3. The carriage 3 is provided movably along a carriage shaft 5 attached to an apparatus body 4. An ink cartridge 2 which is a liquid supply unit is detachably provided on the carriage 3. In the present embodiment, four recording heads 1 are mounted on the carriage 3 and different types of ink, for example, cyan (C), magenta (M), yellow (Y), and black (K) are ejected from four respective recording heads 1. That is, a total of four ink cartridges 2 that respectively storing different types of ink are installed on the carriage 3.

In the present embodiment, although a configuration in which the ink cartridge 2 which is the liquid supply unit is mounted on the carriage 3 is illustrated, the invention is not particularly limited thereto. For example, the liquid supply unit such as an ink tank may be fixed to the apparatus body 4 to connect the liquid supply unit and the recording head 1 through a supply pipe such as a tube.

A driving force of a driving motor 6 is transmitted to the carriage 3 through a plurality of gears (not illustrated) and a timing belt 7 so as to allow the carriage 3 on which the recording head 1 is mounted to reciprocate along the carriage shaft 5. A transport roller 8 is provided on the apparatus body 4 as a transport unit and a recording sheet S which is a medium to be ejected such as paper on which ink is landed is transported by the transport roller 8. The transport unit transporting the recording sheet S is not limited to the transport roller, but may include a belt or a drum.

In the present embodiment, a transportation direction of the recording sheet S is set as a first direction X and an upstream side and a downstream side of the recording sheet S in the transportation direction are respectively set as X1 and X2. The moving direction of the carriage 3 along the carriage shaft 5 is referred to as a second direction Y and one end side of the carriage shaft 5 is set as Y1 and the other end side thereof is set as Y2. A direction crossing both the first direction X and the second direction Y is set as a third direction Z, a recording head 1 side for the recording sheet S is set as Z1, and a recording sheet S side for the recording head 1 is set as Z2. In the present embodiment, although respective directions (X, Y, and Z) are in a relationship orthogonal to each other, an arrangement relationship between respective configurations is not necessarily be limited to have an orthogonal relationship.

In such an ink jet recording apparatus I, ink droplets are ejected from the recording head 1 so as to cause printing to be executed over an approximately entire surface of the recording sheet S while the recording sheet S is transported in the first direction X with respect to the recording head 1 and the carriage 3 is reciprocated in the second direction Y with respect to the recording sheet S.

Figure 2:
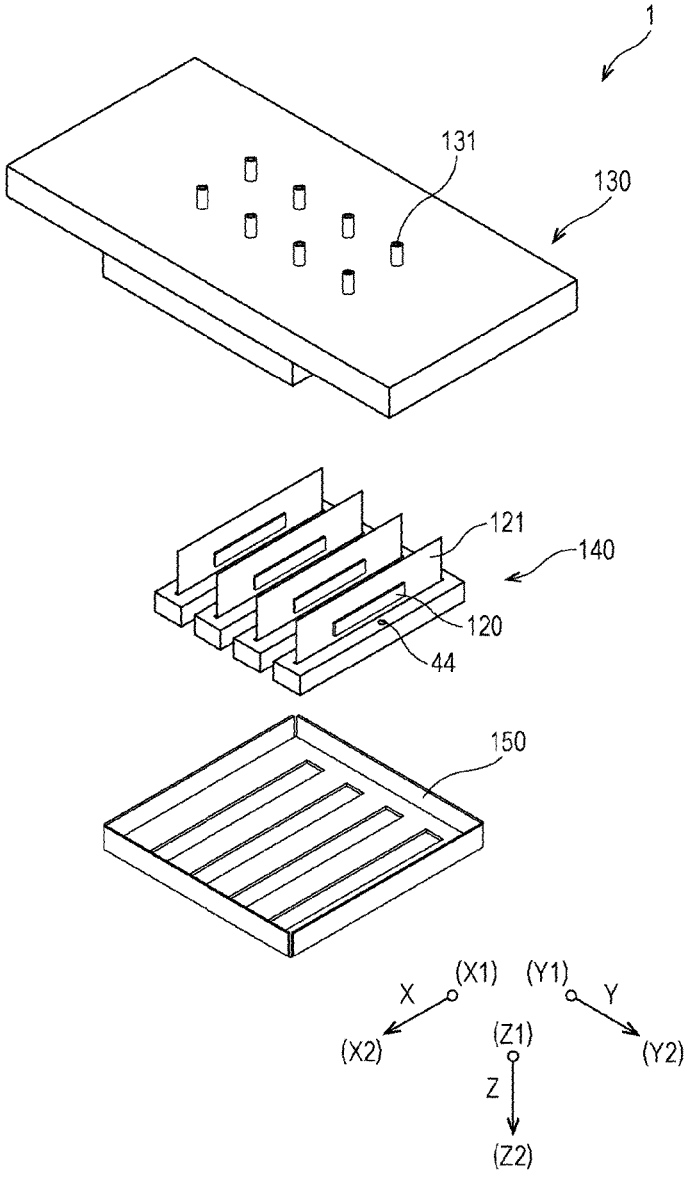
FIG. 2 is an exploded perspective view of a recording head according to Embodiment 1.
Figure 3:
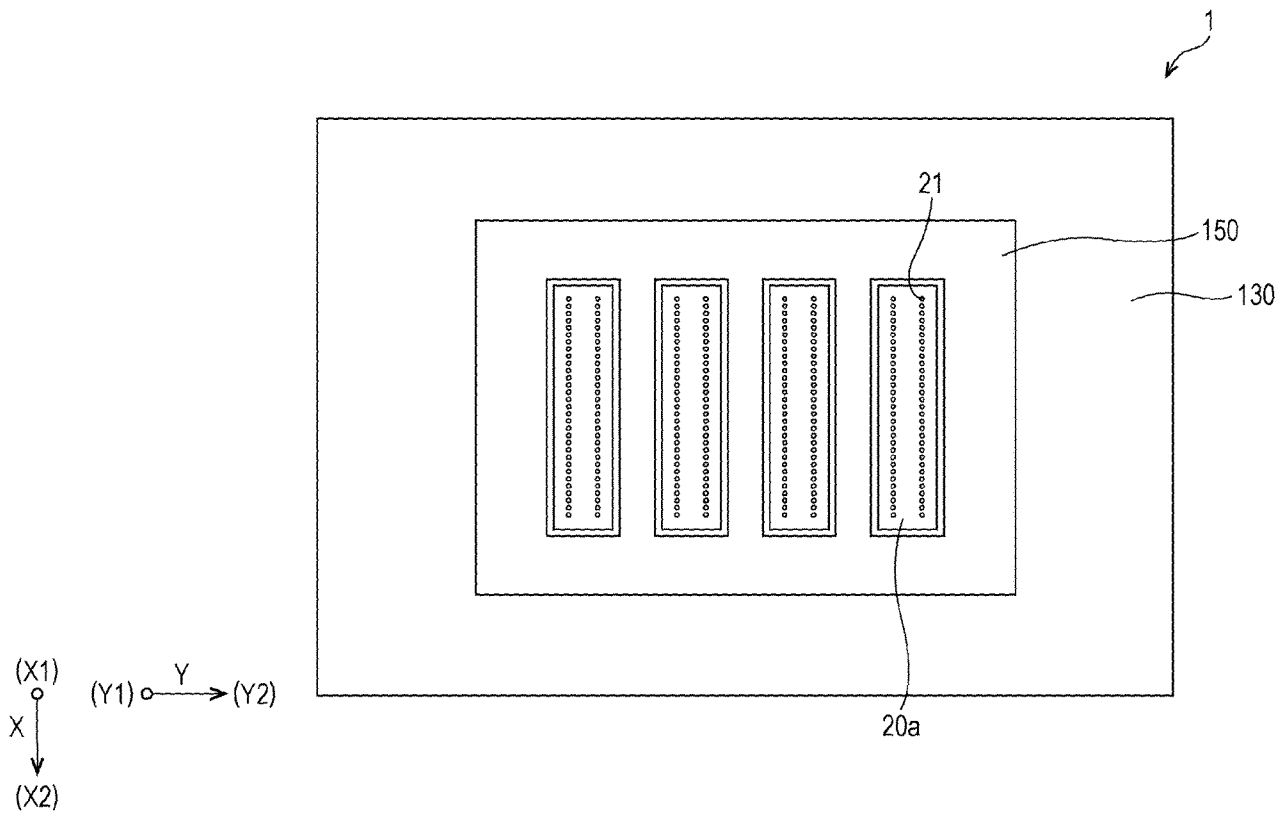
FIG. 3 is a plan view of a liquid ejecting surface side of the recording head according to Embodiment 1.

An example of the head mounted on the ink jet recording apparatus I will be described with reference to FIG. 2 and FIG. 3. FIG. 2 is an exploded perspective view of a recording head according to the present embodiment and FIG. 3 is a plan view of a liquid ejecting surface side of the recording head. In the present embodiment, respective directions of the recording head 1 will be described based on a direction when the recording head 1 is mounted on the ink jet recording apparatus I, that is, the first direction X, the second direction Y, and the third direction Z. Furthermore, arrangement of the recording head 1 within the ink jet recording apparatus I is not limited to the matters to be described in the following.

The recording head 1 includes a head case 130, a chip 140, and a cover head 150.

The head case 130 is a member for supplying ink of the ink cartridge 2 to the chip 140. A plurality of passages are formed inside the head case 130 and supply units 131 which become inlets of the passages are provided on the upper surface side (Z1 side) of the head case 130. The ink cartridge 2 is directly installed on the head case 130, the supply unit 131 is connected to the ink cartridge 2, and ink is supplied to the passages through the supply units 131 from the ink cartridge 2. In a case where the ink cartridge 2 is not directly installed on the head case 130, for example, the ink cartridge 2 and the supply units 131 are connected with each other through a supply pipe such as a tube. The head case 130 can be manufactured at low cost by, for example, molding a resin material. Furthermore, the head case 130 may be formed of a metal material.

Figure 4:
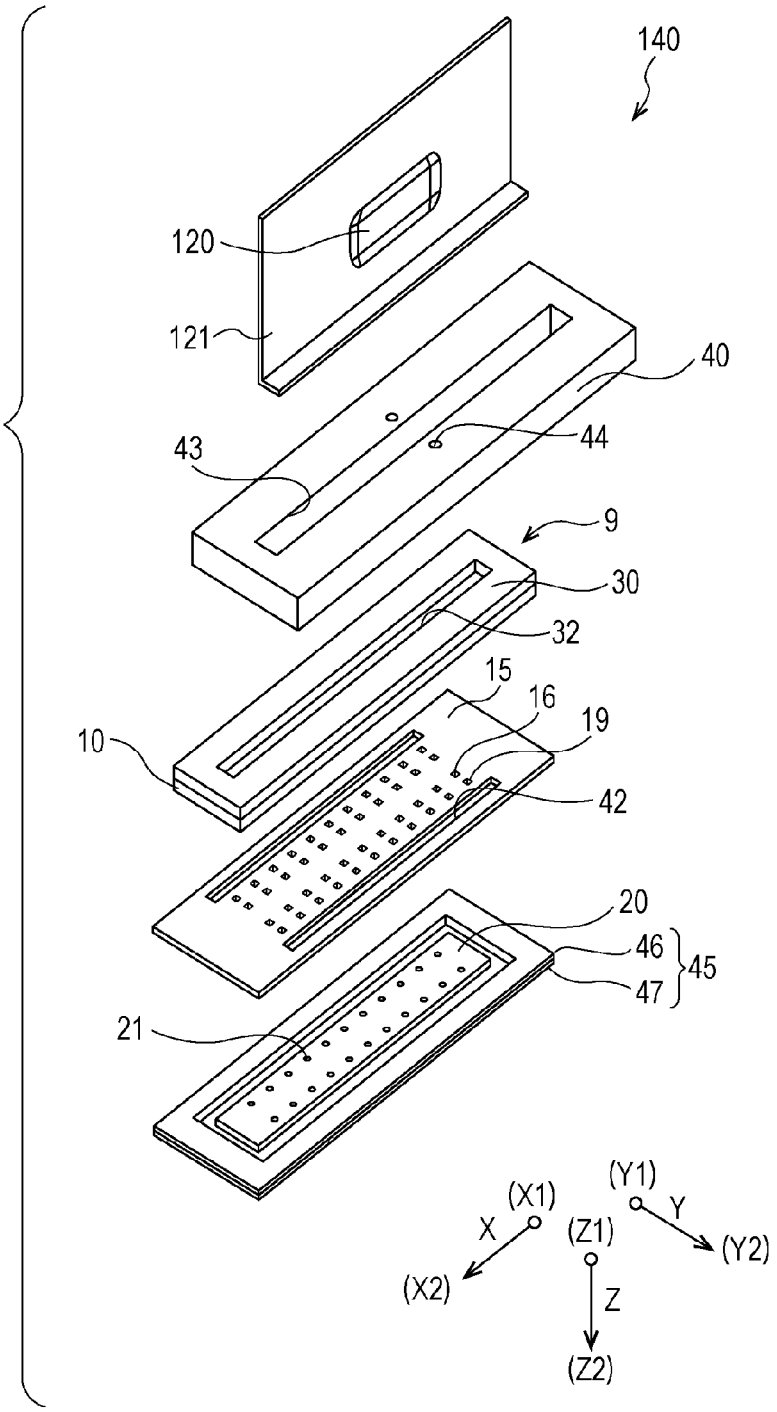
FIG. 4 is an exploded perspective view of a chip according to Embodiment 1.
Figure 5:
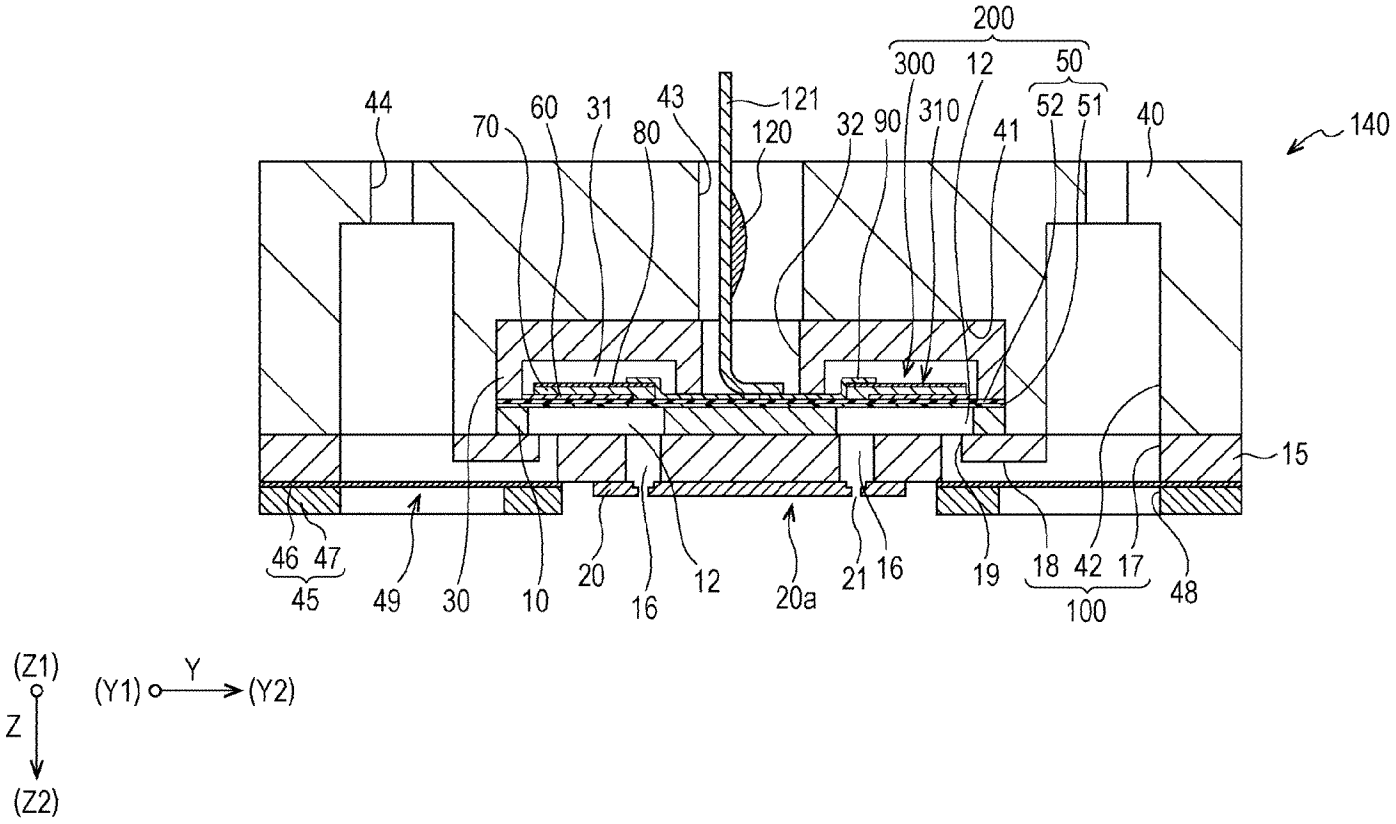
FIG. 5 is a sectional view of the chip according to Embodiment 1.

A plurality of chips 140 are provided on the recording head 1 and each chip 140 is a device including a plurality of segments 200 discharging ink. The chip 140 will be described in detail with reference to FIG. 4 and FIG. 5. FIG. 4 is an exploded perspective view of the chip and FIG. 5 is a sectional view of the chip.

The chip 140 is a device including a plurality of segments 200, and specifically, includes a plurality of members such as a passage forming substrate 10, a communicating plate 15, a nozzle plate 20, a protection substrate 30, a case member 40, and a compliance substrate 45, and the plurality of members are bonded with an adhesive or the like.

For the passage forming substrate 10, metal such as stainless steel or Ni, $ZrO_2$ or $Al_2O_3$ representative of a ceramic material, a glass ceramic material, and an oxide such as MgO or $LaAlO_3$ can be used. In the present embodiment, the passage forming substrate 10 is formed with a silicon single crystal substrate. In the passage forming substrate 10, pressure generating chambers 12 partitioned by a plurality of partition walls formed by causing the passage forming substrate 10 to be subjected to anisotropic etching from one surface side thereof are provided. The pressure generating chambers 12 are arranged in parallel along a direction in which a plurality of nozzle openings 21 discharging ink are arranged in parallel. In the present embodiment, the direction is also called a parallel arrangement direction of the pressure generating chambers 12 and coincides with the first direction X of the ink jet recording apparatus I described above. That is, the recording head 1 is mounted on the ink jet recording apparatus I so that the parallel arrangement direction of the pressure generating chambers 12 (nozzle opening 21) becomes the first direction X. In the passage forming substrate 10, a plurality of rows in which the pressure generating chambers 12 are arranged in parallel in the first direction X are provided, and two rows are provided in the present embodiment. The row arrangement direction in which the plurality of rows of the pressure generating chambers 12 are arranged coincides with the second direction Y of the ink jet recording apparatus I.

In the passage forming substrate 10, a supply passage, which has an opening area narrower than that of the pressure generating chamber 12 and gives a flow passage resistance of ink flowing into the pressure generating chamber 12, or the like may be provided at one end side of the pressure generating chamber 12 in the second direction Y.

A communicating plate 15 is bonded to one surface side (Z2 side) of the passage forming substrate 10. Also, a nozzle plate 20 perforated with the plurality of nozzle openings 21, which communicate to respective pressure generating chambers 12, is bonded to the communicating plate 15.

In the communicating plate 15, a nozzle communication path 16 communicating the pressure generating chamber 12 with the nozzle opening 21 is provided. The communicating plate 15 has an area larger than that of the passage forming substrate 10 and the nozzle plate 20 has an area smaller than that of the passage forming substrate 10. As such, the area of the nozzle plate 20 is made relatively small so as to make it possible to reduce costs. In the present embodiment, a surface in which the nozzle opening 21 of the nozzle plate 20 is open and from which ink droplets are discharged is called a liquid ejection surface 20*a*.

On the communicating plate 15, a first manifold portion 17 and a second manifold portion 18 that constitute a portion of a manifold 100 are provided.

The first manifold portion 17 is provided to penetrate through the communicating plate 15 in a third direction Z which is a thickness direction. The second manifold portion 18 is provided to be open in a nozzle plate 20 side of the communicating plate 15 without penetrating through the communicating plate 15 in the third direction Z.

Furthermore, in the communicating plate 15, a supply communicating path 19 communicating to one end portion of the pressure generating chamber 12 in the second direction Y is independently provided for each pressure generating chamber 12. The supply communicating path 19 communicates the second manifold portion 18 with the pressure generating chamber 12.

As the communicating plate 15, metal such as stainless steel or Ni, ceramics such as zirconium, or the like can be used. A material of the communicating plate 15 preferably has the same linear expansion coefficient as that of the passage forming substrate 10. That is, in a case where a material having a linear expansion coefficient, which is greatly different from that of the passage forming substrate 10, is used as the material of the communicating plate 15, when it is subjected to heating or cooling, warpage occurs due to the difference in the linear expansion coefficient between the passage forming substrate 10 and the communicating plate 15. In the present embodiment, the same material as that of the passage forming substrate 10 is used as the material of the communicating plate 15, that is, a silicon single crystal substrate is used so as to make it possible to suppress occurrence of warpage due to heat, crack due to heat, peeling, or the like.

In the nozzle plate 20, the nozzle openings 21 communicating with respective pressure generating chambers 12 through nozzle communication paths 16. That is, the nozzle openings 21 ejecting the same kind of liquid (ink) are arranged in parallel in the first direction X and two rows of the nozzle openings 21 arranged in parallel in the first direction X are formed in the second direction Y.

As the nozzle plate 20 described above, for example, metal such as stainless steel (SUS), organic materials such as polyimide resin, or the silicon single crystal substrate may be used. The silicon single crystal substrate can be used as the nozzle plate 20 so as to make the linear expansion coefficient of the nozzle plate 20 equal to that of the communicating plate 15 and it is possible to suppress occurrence of warpage due to heating or cooling, crack due to heat, peeling, or the like.

On a side surface opposite to the communicating plate 15, of the passage forming substrate 10, a diaphragm 50 is formed. In the present embodiment, as the diaphragm 50, an elastic film 51 provided on the passage forming substrate 10 side and formed of silicon oxide and an insulator film 52 provided on the elastic film 51 and formed of zirconium oxide are provided. A liquid passage such as the pressure generating chamber 12 is formed in such a way that the passage forming substrate 10 is subjected to anisotropic etching from a surface side thereof to which the nozzle plate 20 is bonded to thereby other surface of the liquid passage such as the pressure generating chamber 12 is defined by the elastic film 51.

On the insulator film 52 of the diaphragm 50, a first electrode 60, a piezoelectric layer 70, and a second electrode 80 are stacked and formed by film deposition or a lithography method to constitute a piezoelectric actuator 300 (example of pressure generating unit in aspects) in the present embodiment. The piezoelectric actuator 300 refers to a portion including the first electrode 60, the piezoelectric layer 70, and the second electrode 80 and a single piezoelectric actuator 300 causes a pressure change in a single pressure generating chamber 12 through the diaphragm 50.

In general, one of the first electrode and the second electrode is used as a common electrode and the other electrode and the piezoelectric layer 70 are patterned for each pressure generating chamber 12 to constitute the plurality of piezoelectric actuators 300. A portion, which is constituted with one of the patterned electrodes and the piezoelectric layer 70 and in which a piezoelectric strain by application of a voltage to both the electrodes is generated, is referred to as a vibration portion 310. In the present embodiment, although the first electrode 60 is used as the common electrode of the piezoelectric actuator 300 and the second electrode 80 is used as an individual electrode of the piezoelectric actuator 300, the first electrode and the second electrode may be reversed depending on the driving circuit or the wiring setup. In the example described above, although the first electrode 60 is continuously provided over the plurality of pressure generating chambers 12 and thus the first electrode 60 functions as a portion of the diaphragm, but is not limited thereto, and only the first electrode 60 may be allowed to function as the diaphragm without providing, for example, one or both of the elastic film 51 and the insulator film 52 described above.

The piezoelectric actuator 300 (pressure generating unit) including the first electrode 60, the piezoelectric layer 70, and the second electrode 80, a single pressure generating chamber 12, and the diaphragm 50 (a portion constituting the diaphragm 50 side (Z1 side) of the pressure generating chamber 12) constitute a single segment 200. The chip 140 includes the plurality of segments 200. In the present embodiment, the chip 140 includes a plurality of segments 200 according to the number of the pressure generating chambers 12.

Each segment 200 has various feature amounts related to ink ejection. For example, there are a natural frequency of the segment 200, a weight of ink ejected from the segment 200, a displacement amount of the diaphragm 50 of the segment 200, and the like.

The plurality of segments 200 are provided on the chip 140 and thus, the natural frequency is present regarding each segment 200. Here, the natural frequency of the segment indicates a natural frequency of the vibration portion 310 constituted with the diaphragm 50, the first electrode 60, the piezoelectric layer 70, and the second electrode 80. The vibration portion 310 refers to a portion including a region that constitutes the pressure generating chamber 12 of the diaphragm 50 and provided to be able to vibrate. In the present embodiment, the piezoelectric actuator 300 is provided at the Z1 side of the diaphragm 50 and thus, the vibration portion 310 also includes a region of the piezoelectric actuator 300 corresponding to the region constituting the pressure generating chamber 12 of the diaphragm 50, in addition to the region constituting the pressure generating chamber 12 of the diaphragm 50. That is, the vibration portion 310 of the present embodiment includes a region defining the pressure generating chamber 12 of the diaphragm 50 and a region corresponding to the region of the diaphragm 50 of the piezoelectric actuator 300 provided on the diaphragm 50.

That is, the vibration portion 310 includes a region constituting the pressure generating chamber 12 of the diaphragm 50 and a film provided on the region. In other words, the vibration portion 310 refers to the diaphragm 50 and a film provided on the diaphragm 50 in plan view when viewed from the third direction Z and in the present embodiment, refers to a portion overlapping an opening of the diaphragm 50 side of the pressure generating chamber 12 in the piezoelectric actuator 300.

The weight of ink ejected from the segment 200 is a weight of ink ejected from the nozzle opening 21 communicating to the pressure generating chamber 12 of each segment 200. The weight of ink ejected from the segment 200 may also be simply called an ink weight of the segment 200.

The displacement amount of the diaphragm 50 of the segment 200 is a difference between the maximum value and the minimum value of displacement of the vibration portion 310 in which a piezoelectric strain is generated by the piezoelectric actuator 300. The displacement amount of the diaphragm 50 is present for each segment 200 of the chip 140. The displacement amount of the diaphragm 50 of the segment 200 may be referred to simply as the displacement amount of the segment 200.

The protection substrate 30 having approximately the same size as the passage forming substrate 10 is bonded to the surface of the piezoelectric actuator 300 side (Z1 side) of the passage forming substrate 10. The protection substrate 30 includes a holding portion 31 which is space for protecting and holding the piezoelectric actuator 300. A through-hole 32 penetrating through the protection substrate 30 in the third direction Z which is the thickness direction is provided in the protection substrate 30. One end of a lead electrode 90 is connected to the second electrode 80 and the other end thereof is extended to be exposed into the through-hole 32. The lead electrode 90 and a wring substrate 121 on which a driving circuit 120 such as a driving IC is mounted are electrically connected with each other in the through-hole 32.

The case member 40 is a member which defines the manifold 100 together with the communicating plate 15. The case member 40 has approximately the same shape as the communicating plate 15 described above in plan view, is bonded to the protection substrate 30, and also bonded to the communicating plate 15 described above. Specifically, the case member 40 includes a concave portion 41, which has a depth allowing the passage forming substrate 10 and the protection substrate 30 to be accommodated, in the protection substrate 30 side. The concave portion 41 has an opening area wider than the surface bonded to the passage forming substrate 10 of the protection substrate 30. In a state where the passage forming substrate 10 or the like is accommodated in the concave portion 41, an opening surface of the nozzle plate 20 side of the concave portion 41 is sealed by the communicating plate 15. With this, a third manifold portion 42 is defined on the outer periphery of the passage forming substrate 10, by the case member 40 and the chip 140. The manifold 100 is constituted with the first manifold portion 17, the second manifold portion 18, and the third manifold portion 42.

As a material of the case member 40, for example, resin, metal, or the like can be used. Also, the case member 40 is molded by a resin material to thereby make it possible to mass-produce at low cost.

The compliance substrate 45 is provided on a surface, to which the first manifold portion 17 and the second manifold portion 18 are open, of the communicating plate 15. The compliance substrate 45 seals an opening at the liquid ejection surface 20*a* side of the first manifold portion 17 and the second manifold portion 18.

In the present embodiment, the compliance substrate 45 includes a sealing film 46 and a fixing substrate 47. The sealing film 46 is formed with a flexible thin film (for example, a thin film formed of polyphenylene sulfide (PPS), stainless steel (SUS), or the like and having a thickness of 20 μm or less) and the fixing substrate 47 is formed of a hard material such as metal, for example, stainless steel (SUS). A region, which opposes the manifold 100, of the fixing substrate 47 is formed into an opening 48 in which a portion of the fixing substrate 47 is completely removed in the thickness direction and thus, one surface of the manifold 100 is formed into a compliance portion 49 which is a flexible portion sealed by only the sealing film 46 having flexibility.

An introducing passage 44 for supplying ink to each the manifold 100 by being communicated to the manifold 100 is provided in the case member 40. A connection port 43 which is communicated to the through-hole 32 of the protection substrate 30 and into which the wring substrate 121 is inserted is provided in the case member 40.

In the chip 140 having such a configuration, when ink is ejected, ink is taken from the introducing passage 44 through the head case 130 from the ink cartridge 2 and inside the flow passage extending from the manifold 100 to the nozzle opening 21 is filled with ink. Thereafter, a voltage is applied to each piezoelectric actuator 300 corresponding to the pressure generating chamber 12 according to a signal from the driving circuit 120 to thereby deform the diaphragm 50 together with the piezoelectric actuator 300. With this, the pressure inside the pressure generating chamber 12 is made higher and ink droplets are ejected from a predetermined nozzle opening 21.

As illustrated in FIG. 2 and FIG. 3, four chips 140 are fixed on the head case 130 described above at predetermined intervals in the arrangement direction of nozzle rows, that is, the second direction Y. That is, eight nozzle rows in which the nozzle openings 21 are arranged in parallel are provided in the recording head 1 of the present embodiment. As such, forming of a multi-row structure of nozzle rows is achieved by using a plurality of chips 140 so as to make it possible to prevent reduction of yield compared to a case where multiple nozzle rows are formed in a single chip 140. The plurality of chips 140 are used in order to achieve forming of a multi-row structure of nozzle rows and accordingly, it is possible to increase the number of attainable chips 140 capable of being formed from a single wafer and reduce an unnecessary area of a silicon wafer to reduce manufacturing cost.

The liquid ejection surface 20*a* side of four chips 140 fixed on the head case 130 is covered by cover head 150 in a state where the nozzle opening 21 is exposed. As a material of the cover head 150, for example, a metal material such as stainless steel, a ceramic material, a glass ceramic material, oxide, or the like can be used.

Such a recording head 1 is mounted on the ink jet recording apparatus I so that the second direction Y becomes the moving direction of the carriage 3 as described above.

Figure 6:
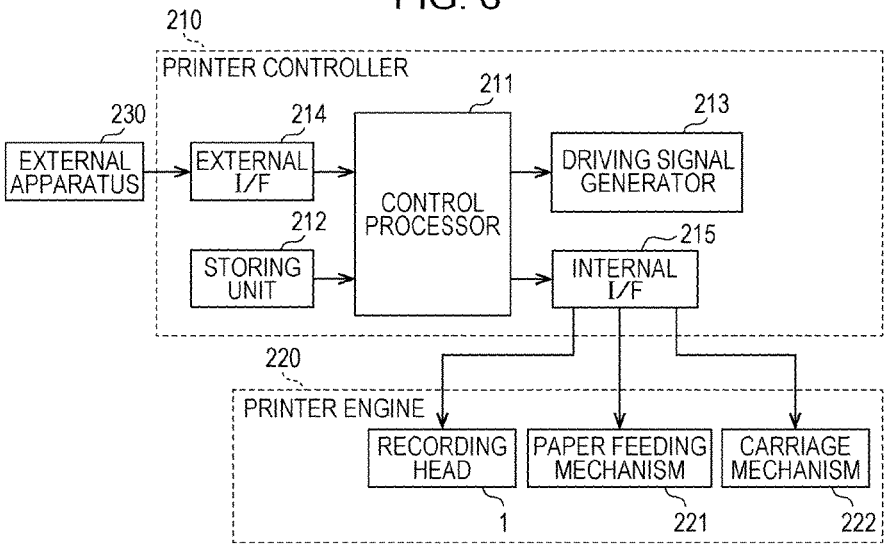
FIG. 6 is a block diagram of an ink jet recording apparatus according to Embodiment 1.

The ink jet recording apparatus I includes a control device 250 (see FIG. 1). Here, description will be made on control of the ink jet recording apparatus I of the present embodiment with reference to FIG. 6. FIG. 6 is a block diagram of an ink jet recording apparatus according to the present embodiment.

The ink jet recording apparatus I includes a printer controller 210 which is a controller of the present embodiment and a printer engine 220.

The printer controller 210 is an element controlling the entirety of the ink jet recording apparatus I and is provided in the control device 250, which is installed in the ink jet recording apparatus I in the present embodiment.

The printer controller 210 includes a control processor 211 configured with a CPU or the like, a storing unit 212, a driving signal generator 213, an external interface (I/F) 214, and an internal I/F 215.

Print data indicating an image to be printed on the recording sheet S is transmitted to the external I/F 214 from the external apparatus 230 such as a host computer and the printer engine 220 is connected to the internal I/F 215. The printer engine 220 is an element recording an image onto a recording sheet S under the control of the printer controller 210 and includes the recording head 1, a paper feeding mechanism 221 such as a transport roller 8 or a motor (not illustrated) driving the transport roller 8, a carriage mechanism 222 such as a driving motor 6 or a timing belt 7.

The storing unit 212 includes a ROM storing a control program or the like therein and a RAM in which various pieces of data needed to print an image are temporarily stored. The control processor 211 executes a control program stored in the storing unit 212 to thereby comprehensively control respective elements of the ink jet recording apparatus I. The control processor 211 converts print data transmitted to the external I/F 214 from the external apparatus 230 into head control signals, that instruct each piezoelectric actuator 300 about ejection/non-ejection of ink droplets from each nozzle opening 21 of the recording head 1 and include, for example, a clock signal CLK, a latch signal LAT, a change signal CH, pixel data SI, and setting data SP, and transmits the converted signal to the recording head 1 through the internal I/F 215. The driving signal generator 213 generates and transmits a driving signal (COM) to the recording head 1 through the internal I/F 215. That is, head control data or ejection data such as a driving signal is transmitted to the recording head 1 through the internal I/F 215 which is a transmitter.

The recording head 1 to which ejection data such as the head control signal, the driving signal, or the like is supplied from the printer controller 210 generates a driving waveform from the head control signal and the driving signal and applies the driving waveform to the piezoelectric actuator 300.

The printer controller 210 generates a movement control signal of the paper feeding mechanism 221 and the carriage mechanism 222 from print data received from the external apparatus 230 through the external I/F 214, transmits the movement control signal to the paper feeding mechanism 221 and the carriage mechanism 222 through the internal I/F 215, and controls the paper feeding mechanism 221 and the carriage mechanism 222.

Here, description will be made on image processing performed before print data received from the external apparatus 230 is converted into the head control signal, in the printer controller 210.

Print data is bit map data represented in color space of the CMYK which represents an image or characters intended to print and the concentration gradation value of each of the C, M, Y, and K is represented by, for example, 0 to 255. Bit map data described above is converted into data represented by a dot generation ratio according to a dot generation amount table. In the present embodiment, three kinds of dots of a small dot (S), a medium dot (M), and a large dot (L) of ink capable of being ejected from the nozzle opening 21 of each segment 200 are present and the concentration gradation value (0 to 255) is converted into data of a generation ratio of the three dots.

The dot generation amount table is a table in which the dot generation ratios of the three dots are correlated with the concentration gradation values (0 to 255) of each of the C, M, Y, and K, and which is defined for each segment 200 and is stored in the storing unit 212.

Figure 7:
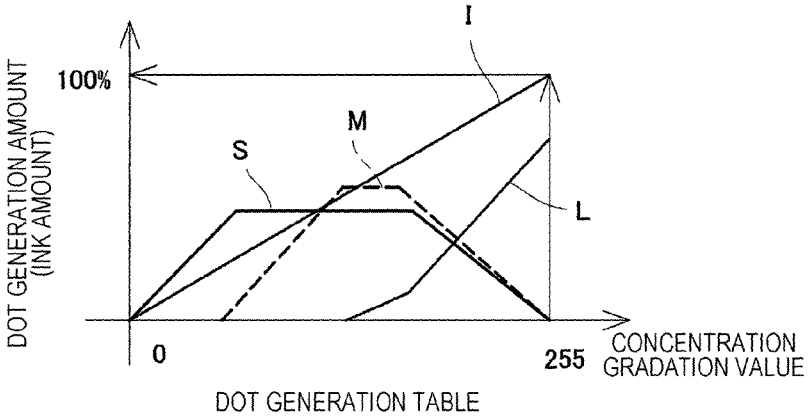
FIG. 7 is a diagram illustrating a dot generation amount table according to Embodiment 1 in a graph form.

FIG. 7 is a diagram illustrating a dot generation amount table in a graph form. The horizontal axis represents a concentration gradation value before a dot is decomposed and the vertical axis represents a dot generation ratio after the dot is decomposed. Graphs S, M, and L represent generation ratios of a small dot, a medium dot, and a large dot, respectively. In a case where the concentration gradation value is small, only the small dots are generated and printing with a low density is made and in a case where the concentration gradation value is large, three dots including the large dot are generated and printing with a high density is implemented.

Image processing by the printer controller 210 is processing of converting an input concentration gradation value into an ink weight to be actually ejected from the nozzle opening 21 of each segment 200 using the dot generation amount table. By this processing, for each segment 200, a weight of ink itself (a total ink weight to be discharged through three dots) is determined with respect to the input concentration gradation value and furthermore, how to distribute the same ink weight to the three dots is determined.

The straight line I of FIG. 7 represents determined ink weights of the former and when the ink weights indicated by the straight line I (here, represented by %) are represented by discharge of the small dot, the medium dot, and the large dot, graphs S, M, and L are obtained. In this way, the concentration gradation value of each color is converted into data of an ink weight represented by three kinds of dots. Print data is converted into the head control signal described above based on data of the ink weight and the head control signal is transmitted to the recording head 1.

Here, a manufacturing method of the recording head 1 described above will be described.

First, a plurality of chips 140 used for the recording head 1 are manufactured. The manufacturing method of the chip 140 is not particularly limited and the chip 140 can be manufactured by a well-known manufacturing method. Next, for each chip 140, a natural frequency of the segment 200 included in each chip 140 is measured.

The natural frequency of the segment 200 can be measured by a well-known device and method. For example, a specific Sin wave is input to the segment 200 to measure impedance of the segment 200 using a well-known measuring instrument called an impedance analyzer. A frequency of the Sin wave to be input is changed to change impedance of the segment 200. The frequency of an input Sin wave having the peak of impedance can be measured as the natural frequency of the segment 200. The segments 200 targeted for natural frequency measurement may be all segments 200 included in the chip 140 or may be a plurality of arbitrarily selected segments 200. In the present embodiment, it is regarded that one hundred segments 200 are present in each chip 140 and the natural frequency is measured for one hundred segments 200.

Next, the chips 140 are ranked using the mode value of the natural frequency of the chip 140 as a reference. The mode value of the natural frequency of the chip 140 is a value, which appears most frequently, among the natural frequencies obtained by measuring respective segments 200 for a single chip 140. Classifying the chips 140 into ranks by using the mode value of the natural frequency as a reference refers to matters that the chips 140 of which the mode values of the natural frequency are the same or fall within a predetermined range have the same rank.

Figure 8:
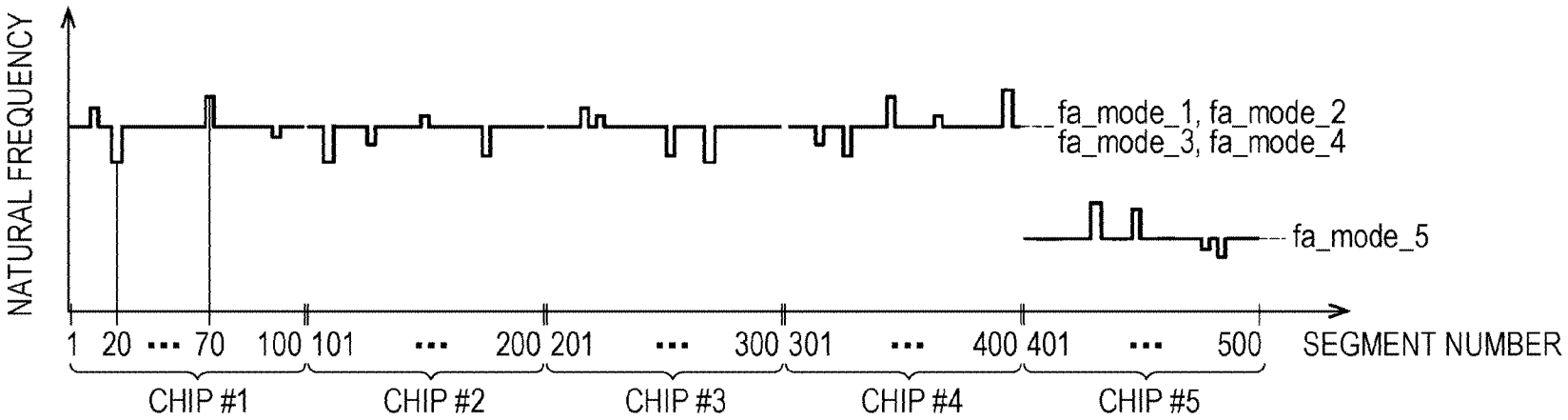
FIG. 8 is a diagram illustrating an example of rank according to Embodiment 1.

An example of rank classification is illustrated in FIG. 8. The horizontal axis represents the segment number given to the segments 200 of each chip and the vertical axis represents the natural frequency. Here, matters about five chips 140 are illustrated. When the chips 140 are individually referenced, the chips 140 may be referred to as a chip #1, a chip #2, a chip #3, a chip #4, and a chip #5, respectively. The segment numbers are numbers respectively given to one hundred segments 200 of each of the chips #1 to #5. The segment numbers from 1 to 100 (hereinafter, will be described as segment #1 to #100) are given to one hundred segments 200 of the chip #1. Similarly, the segments #101 to #200 are given to the chip #2, the segments #201 to #300 are given to the chip #3, the segments #301 to #400 are given to the chip #4, and the segments #401 to #500 are given to the chip #5.

In FIG. 8, the natural frequencies measured for respective segments #1 to #500 of respective chips #1 to #5 are illustrated. The mode value of the natural frequency of each of the segments #1 to #100 included in the chip #1 is regarded as the mode value fa_mode_1 of the natural frequency of the chip #1. For example, in the chip #1, the mode value of the natural frequencies of most segments is the mode value fa_mode_1 and natural frequencies of some segments are smaller than or larger than the mode value. Similarly, the mode values of the natural frequencies of the chips #2 to #5 are regarded as the mode values fa_mode_2 to fa_mode_5, respectively. In the present embodiment, the fa_mode_1 to fa_mode_4 are the same value and the fa_mode_5 is smaller than the fa_mode_1 to fa_mode_4.

The chips are ranked based on the mode value described above. For example, the chips having the same mode value are regarded as the same rank. Accordingly, the chips #1 to #4 are classified into the same rank having the same mode value of the natural frequency and the chip #5 is classified into another rank.

Also, an aspect of classification of the chips into ranks based on the mode value does not need to be performed according to whether the ranks are the same or not. For example, a range of a natural frequency may be defined for each rank, a range in which the mode value of the natural frequency is included may be specified for each chip, and the chip may be ranked as a rank corresponding to the range.

Figure 9:
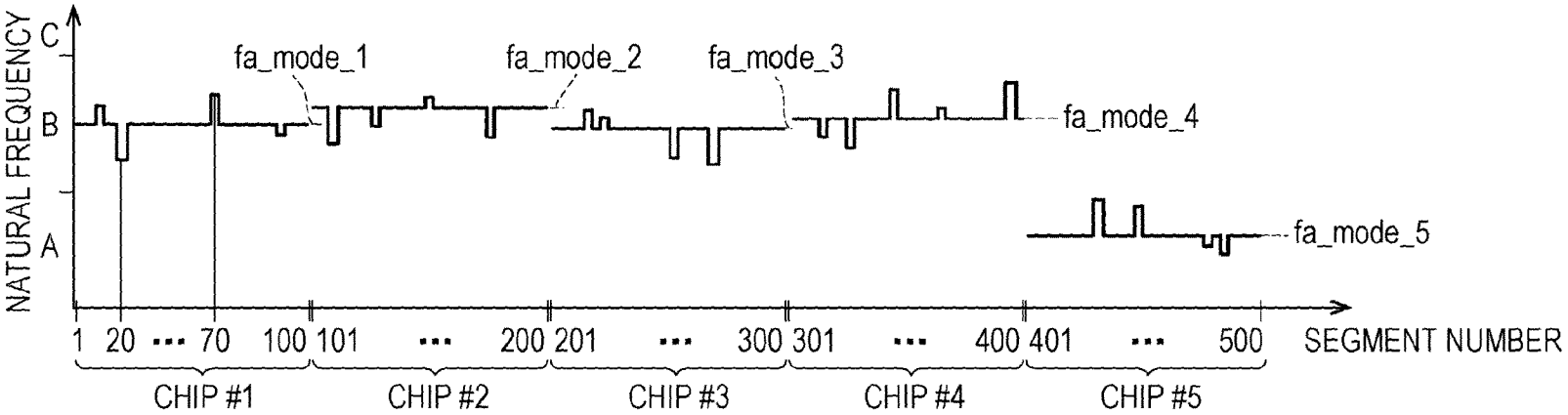
FIG. 9 is a diagram illustrating another example of rank according to Embodiment 1.

An example of rank classification is illustrated in FIG. 9. As illustrated in FIG. 9, ranks are classified into three ranks and a range A, a range B, and a range C of the natural frequencies that respectively correspond to the ranks are defined. Differently from the example of FIG. 8, the mode values fa_mode_1 to fa_mode_5 of natural frequencies of the chips #1 to #5 are not the same. For example, for the chip #1, the range B in which the mode value fa_mode_1 of the natural frequency of the chip #1 is included is specified. In this case, the rank corresponding to the range B is set as a rank of the chip #1. For other chips #2 to #5, ranges are also defined similarly.

In the example of FIG. 9, the same rank is set for the chips #1 to #4 and another rank is set for the chip #5. How to acquire such a range is not particularly limited.

Here, the natural frequency of each segment has correlation with the weight of ink ejected from each segment. Accordingly, when the same driving signal is applied to respective segments to discharge ink, variation also occurs between the ink weights ejected from respective segments due to variation in the natural frequencies. Variation in the ink weights due to variation in the natural frequencies can be suppressed by correcting print data described above. However, there is a limit to the range within which print data can be corrected.

Accordingly, in a case where the range of the natural frequency is defined for each rank, it is preferable to obtain a range within which variation in the ink weights can be suppressed by correcting print data and to rank the chips using the range of the natural frequency corresponding to the obtained range. For example, a range of a single rank is preferably set to the range of the natural frequency at which the ink weight equals to an amount within ±5%. This is because substantially the same image quality is obtained at the range in which the ink weight falls within ±5%.

In the example of FIG. 9, the mode values of the natural frequencies of the chips #1 to #4 are present within the range B of the same rank. The range B corresponds to a range of the natural frequency, which is in the degree to which variation in the ink weights ejected from respective segments of the chips #1 to #4 is substantially removed, by correction. However, for the chip #5, even when correction is performed, the natural frequency of the chip #5 is unable to cause the same ink weight as those of other chips #1 to #4 and thus, the chip #5 is ranked as another rank.

In a case where the natural frequencies differ greatly between the segments of a single chip 140, variation is not corrected even when correction is made and variation occurs in the ink weights. However, such a chip 140 is not usually used. In the aspect in which the range of the natural frequency is defined for each rank, the range of the natural frequency does not need to be set as the range of the natural frequency within which print data described above can be corrected and may be set as an arbitrary range.

In a case where a range of the natural frequencies defined for each rank, for example, a range of the ranks may be set so that divisions of which the number is greater than or equal to 10 and less than or equal to 50 are made between the minimum value and maximum value of the mode value of the natural frequencies. The minimum value of the mode values of the natural frequencies refers to the minimum value among the mode values obtained from each of the plurality of chips. The maximum value of the mode values of the natural frequencies refers to the maximum value among the mode values obtained from each of the plurality of chips.

Next, the recording head 1 is manufactured by using the chip 140 selected based on rank classification performed as described above. The chip 140 selected based on ranks is, for example, the chip 140 classified into the same rank, and in the examples of FIG. 8 and FIG. 9, the chips #1 to #4 correspond to the chips 140 classified into the same rank. Also, the recording head 1 may be manufactured by using the chip 140 in such a way that, for example, two (or a plurality of) consecutive ranks are selected and the chips 140 classified into the ranks are used without being limited to the case where the chips 140 having the same rank are selected.

The dot generation amount table of the recording head 1 including the chip 140 selected based on ranks is prepared as follows.

Figure 10A:
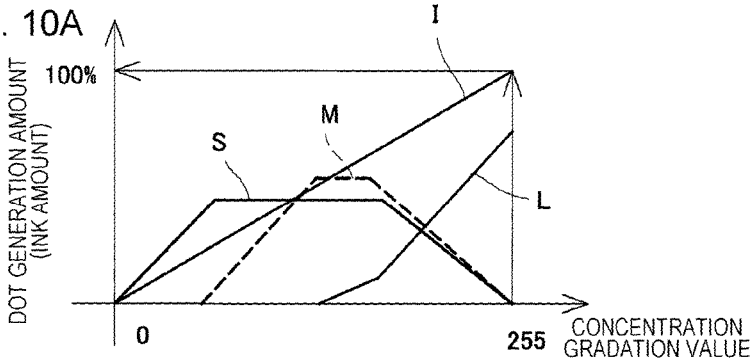
FIGS. 10A, 10B, and 10C are diagrams illustrating another dot generation amount table according to Embodiment 1.
Figure 10B:
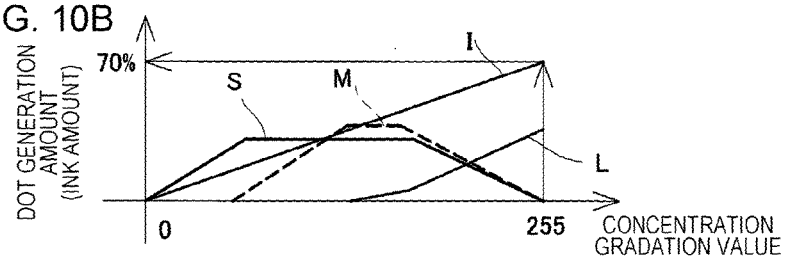
Figure 10C:
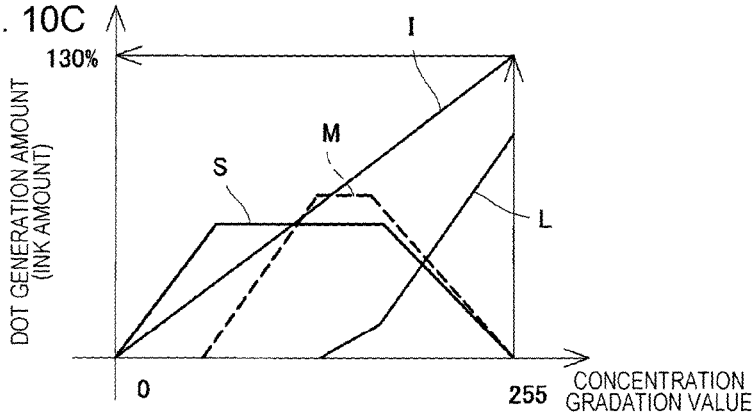

FIGS. 10A, 10B, and 10C are diagrams illustrating the dot generation amount table in a graph form. The horizontal axis and the vertical axis of FIGS. 10A, 10B, and 10C are the same as those of FIG. 7. FIG. 10A is a dot generation amount table for a segment (for example, segment #1), of which the natural frequency is the mode value (fa_mode_1), among the segments of the chip #1 illustrated in FIG. 8. FIG. 10B is a dot generation amount table for a segment (for example, segment #20), of which the natural frequency is smaller than the mode value (fa_mode_1), among the segments of the chip #1 illustrated in FIG. 8. FIG. 10C is a dot generation amount table for a segment (for example, segment #70), of which the natural frequency is larger than the mode value (fa_mode_1), among the segments of the chip #1 illustrated in FIG. 8.

First, as illustrated in FIG. 10A, a dot generation amount table is prepared for the segment #1 of which the natural frequency is the mode value.

The natural frequency of the segment has correlation with the ink weight to be ejected from the segment and the higher the natural frequency, the smaller the ink weight. For that reason, even when the segment is controlled to eject the same ink weight, the ink weight of dots actually ejected from the segment #20 becomes larger than the ink weight of dots actually ejected from the segment #1. In contrast, the ink weight of dots actually ejected from the segment #70 becomes smaller than the ink weight of dots actually ejected from the segment #1.

For that reason, even when the same concentration gradation value is taken, the segment #20 which ejects ink of which the weight is large, that is, the segment #20, of which the natural frequency is smaller than the mode value, is corrected so that the ink weight becomes small.

For example, as illustrated in FIG. 10B, the dot generation amount table of the segment #20 is prepared by performing correction to reduce the dot generation amount by using the dot generation amount table of the segment #1 of which the natural frequency is the mode value as a reference. Here, the ink weight of the segment #1 illustrated in FIG. 10A is corrected to become 70% thereof to be set as the ink weight of the segment #20. An amount to be corrected is suitably determined based on the difference between the natural frequency of the segment #20 and the mode value.

Also, even when the same concentration gradation value is taken, the segment #70 which ejects ink of which the weight is small, that is, the segment #70 of which the natural frequency is larger than the mode value is corrected so that the ink weight is increased.

For example, as illustrated in FIG. 10C, the dot generation amount table of the segment #70 is prepared by performing correction to increase the dot generation amount by using the dot generation amount table of the segment #1 of which the natural frequency is the mode value as a reference. Here, the ink weight of the segment #1 illustrated in FIG. 10A is corrected to become 130% thereof to be set as the ink weight of the segment #70. An amount to be corrected is suitably determined based on the difference between the natural frequency of the segment #70 and the mode value.

In a case where the dot generation amount tables illustrated in FIGS. 10A, 10B, and 10C are used, even when the same concentration gradation value is taken, the ink weight is different among the segment #1, the segment #20, and the segment #70. However, when ink is actually ejected using the head control signal based on the ink weight, there is no actual difference in the ink weight between the segments and dots of which variation is suppressed can be formed. That is, it is possible to suppress variation in the ink weight between the segments due to the difference of the natural frequency.

Also, regarding a segment other than the segment #1, the segment #20, and the segment #70, similarly, the dot generation amount table is prepared based on the difference of the natural frequency and is stored in the storing unit 212.

According to the manufacturing method of the present embodiment as described above, the recording head 1 is manufactured by classifying the chips 140 into ranks using the mode value of the natural frequency of the segment 200 as a reference and by selecting the chip 140 based on the ranks. With this, it is possible to manufacture the recording head 1 including the plurality of chips 140 in which variation in ink ejection characteristics of respective segments is suppressed.

According to the manufacturing method of the present embodiment, it is possible to manufacture the recording head 1 in which the mode values of the natural frequencies of the chips 140 (chips #1 to #4) belong to the same rank. With this, it is possible to reduce a correction amount of the dot generation amount table which becomes a reference. In the example of FIG. 8, most of the segments of the chips #1 to #4 are aligned at the mode value and thus, the dot generation amount tables for these segments do not need to be corrected. In other words, the dot generation amount table may be corrected for only the segment of which the natural frequency is smaller than or larger than the mode value. As such, according to the manufacturing method of the present embodiment, it is possible to reduce the number of segments which become targets for correction of the dot generation amount table.

Figure 11A:
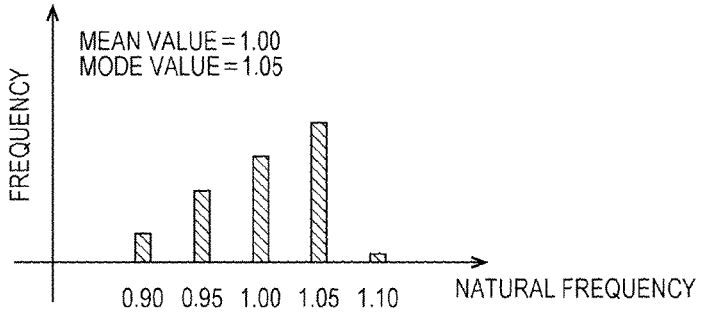
FIGS. 11A, 11B, and 11C are graphs illustrating frequency distribution of natural frequencies.
Figure 11B:
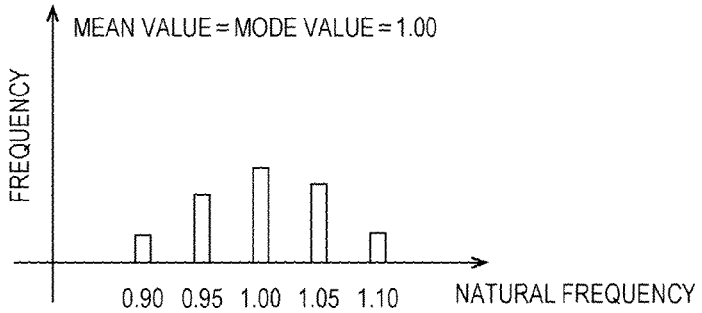
Figure 11C:
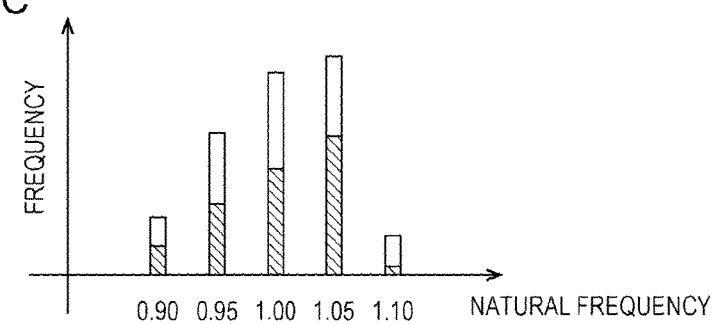

This will be described in detail based on FIGS. 11A to 11C and 12A to 12C. FIGS. 11A, 11B, and 11C are graphs illustrating frequency distribution of natural frequencies in a case where the recording head 1 is manufactured using the chips 140 which are ranked by using the average value as a reference. FIG. 11A illustrates frequency distribution of natural frequencies of the chip #1, FIG. 11B illustrates frequency distribution of natural frequencies of the chip #2, and FIG. 11C illustrates frequency distribution of natural frequencies obtained by combining the chip #1 and the chip #2.

It is assumed that the average value and the mode value of the natural frequencies of the chip #1 illustrated in FIG.

11A are 1.00 and 1.05, respectively. In the chip 140, variation is present in the natural frequency of each segment 200 and the average value and the mode value may differ from each other, like the chip #1. It is assumed that both the average value and the mode value of the natural frequencies of the chip #2 illustrated in FIG. 11B are 1.00.

In a case where rank classification is performed by using the average value as a reference, the chip #1 and the chip #2 are classified into the same rank. As illustrated in FIG. 11C, in frequency distribution of the chip #1 and the chip #2 having the same rank obtained through rank classification using the average value as a reference, the frequency of the natural frequency of 1.05 is the highest frequency and the frequency of the natural frequency of 1.00 is the second-highest frequency. That is, the frequency of the segment of which the natural frequency is the average value may not become the most frequency. Although matters about a chip #3 and a chip #4 are not particularly illustrated, when rank classification is performed by using the average value as a reference, the frequency of the segments each of which has the natural frequency of the average value may not become the most frequency.

In the recording head 1 including the chip #1 to chip #4 described above, the number of segments which become targets for correction is increased. For example, segments of which the natural frequency is other than the average value are set as targets for correction by using the segments of which the natural frequency is the average value. In this case, the segments of which the natural frequency is the mode value needs to become the targets for correction and the number of targets for correction is increased.

Figure 12A:
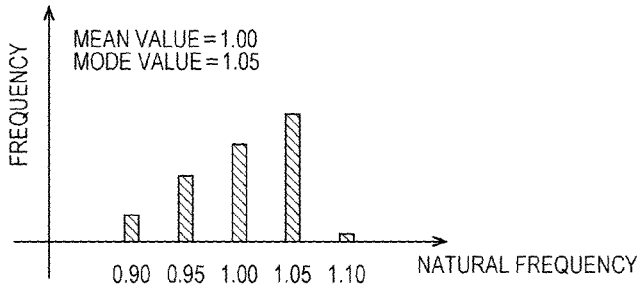
FIGS. 12A, 12B, and 12C are graphs illustrating frequency distribution of natural frequencies.
Figure 12B:
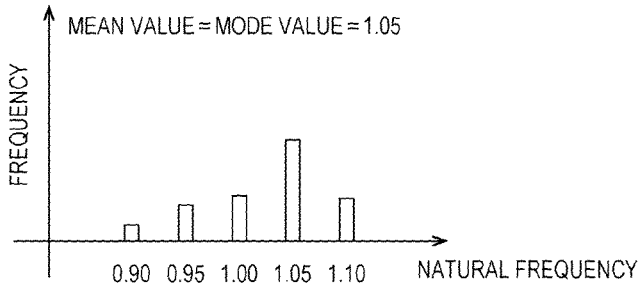
Figure 12C:
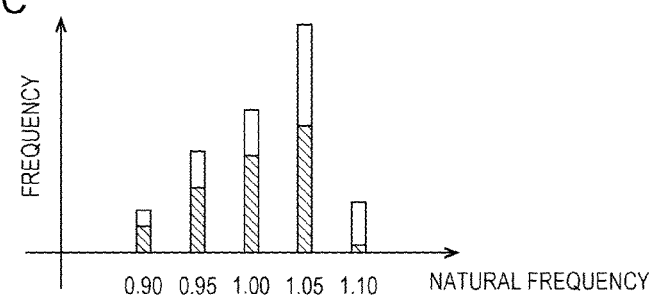

FIGS. 12A, 12B, and 12C are graphs illustrating frequency distribution of natural frequencies in a case where the recording head 1 is manufactured using the chips 140 which are ranked by using the mode value as a reference. FIG. 12A illustrates frequency distribution of natural frequencies of the chip #1, FIG. 12B illustrates frequency distribution of natural frequencies of the chip #2, and FIG. 12C illustrates frequency distribution of natural frequencies obtained by combining the chip #1 and the chip #2.

It is assumed that the average value and the mode value of the natural frequencies of the chip #1 illustrated in FIG. 12A are 1.00 and 1.05, respectively. It is assumed that both the average value and the mode value of the natural frequencies of the chip #2 illustrated in FIG. 12B are 1.05.

In a case where rank classification is performed by using the mode value as a reference, the chip #1 and the chip #2 are classified into the same rank. As illustrated in FIG. 12C, in frequency distribution of the chip #1 and the chip #2 having the same rank obtained through rank classification using the mode value as a reference, the frequency of the segment having the natural frequency of the mode value becomes the most frequency, as a matter of course. Although matters about the frequency distribution obtained by combining the chip #3 and the chip #4 are not particularly illustrated, when rank classification is performed by using the mode value as a reference, the frequency of the segments each of which has the natural frequency of the mode value becomes the most frequency.

As such, according to the manufacturing method of the present embodiment, the recording head 1, which includes the chip #1 to the chip #4 ranked by using the mode value as a reference, is manufactured. With this, the segment having the natural frequency of the mode value does not need to be set as a correction target. That is, it is possible to reduce the number of segments which become targets for correction of the dot generation amount table.

Furthermore, according to the manufacturing method of the present embodiment, it is possible to reduce the number of segments, which become targets for correction of the dot generation amount table and thus, it is possible to reduce the computation time relating to image processing using the dot generation amount table.

Furthermore, according to the manufacturing method of the present embodiment, correction of the dot generation amount table is performed for the segment of which the natural frequency is smaller than or larger than the mode value, based on the difference between the natural frequency of the segment and the mode value of the natural frequency. As such, according to the manufacturing method of the present embodiment, it is possible to correct the dot generation amount table without ejecting ink from the recording head 1.

When ink is actually ejected from respective segments and variation is present in the ink weight, it is possible to correct the dot generation amount table so that variation in the ink weight is corrected. However, in this case, supplying of ink to the recording head 1 from the ink cartridge 2, actual transmitting of the driving signal to the recording head 1, ejecting of ink, and measuring of the weight of ejected ink are needed. On the other hand, according to the manufacturing method of the present embodiment, ink does not also need to be supplied to the recording head 1, ink does not need to be actually ejected, and when the natural frequency of the segment is measured, rank classification is performed so as to make it possible to manufactures the recording head 1.

In the recording head 1 manufactured by the manufacturing method of the present embodiment, the natural frequency of the segment 200 of the chip 140 satisfies the following expression.

$$\sum_{i=1}^{n}(\text{fa_mode_i} - \text{fa_mode_ave})^2 < \sum_{i=1}^{n}(\text{fa_ave_i} - \text{fa_ave_ave})^2 \tag{1}$$

$$\sum_{i=1}^{n}(\text{fa_mode_i} - \text{fa_mode_ave})^2 < \sum_{i=1}^{n}(\text{fa_max_i} - \text{fa_max_ave})^2 \tag{2}$$

$$\sum_{i=1}^{n}(\text{fa_mode_i} - \text{fa_mode_ave})^2 < \sum_{i=1}^{n}(\text{fa_min_i} - \text{fa_min_ave})^2 \tag{3}$$

$$\sum_{i=1}^{n}(\text{fa_mode_i} - \text{fa_mode_ave})^2 < \sum_{i=1}^{n}(\text{fa_med_i} - \text{fa_med_ave})^2 \tag{4}$$

$$\text{fa_mode_ave} = \left(\sum_{i=1}^{n}\text{fa_mode_i}\right)\Big/ n$$

$$\text{fa_ave_ave} = \left(\sum_{i=1}^{n}\text{fa_ave_i}\right)\Big/ n$$

$$\text{fa_max_ave} = \left(\sum_{i=1}^{n}\text{fa_max_i}\right)\Big/ n$$

$$\text{fa_min_ave} = \left(\sum_{i=1}^{n}\text{fa_min_i}\right)\Big/ n$$

$$\text{fa_med_ave} = \left(\sum_{i=1}^{n}\text{fa_med_i}\right)\Big/ n$$

Here, i is an integer from 1 to n, n is the number of chips 140 included in the recording head 1, and fa_mode_i is the mode value of the natural frequencies of a plurality of segments 200 included in an i-th chip 140.

Since four chips 140 are present in the example illustrated in FIG. 8, n is 4, and regarding fa_mode_i, if i=1, fa_mode_i is fa_mode_1, if i=2, fa_mode_i is fa_mode_2, if i=3, fa_mode_i is fa_mode_3, and if i=4, fa_mode_i is fa_mode_4.

fa_ave_i is the average value of the natural frequencies of the plurality of segments 200 included in the i-th chip 140.

fa_max_i is the maximum value of the natural frequencies of the plurality of segments 200 included in the i-th chip 140.

fa_min_i is the minimum value of the natural frequencies of the plurality of segments 200 included in the i-th chip 140.

fa_med_i is the median value of the natural frequencies of the plurality of segments 200 included in the i-th chip 140.

The mode value, the average value, the maximum value, the minimum value, and the median value may be obtained from the natural frequencies of all segments included in the i-th chip 140 and may be obtained from the natural frequencies of arbitrary number of segments 200.

Each of left sides of the expression (1) to expression (4) is the square sum of the difference between the average value of the mode values of all chips 140 and the mode value of each chip 140. This square sum of the difference represents variation in the mode values of the natural frequencies of all chips 140.

The right side of the expression (1) is the square sum of the difference between the average value of the average values of all chips 140 and the average value of each chip 140. This square sum of the difference represents variation in the average values of the natural frequencies of all chips 140.

The right side of the expression (2) is the square sum of the difference between the average value of the maximum values of all chips 140 and the maximum value of each chip 140. This square sum of the difference represents variation in the maximum values of the natural frequencies of all chips 140.

The right side of the expression (3) is the square sum of the difference between the average value of the minimum values of all chips 140 and the minimum value of each chip 140. This square sum of the difference represents variation in the minimum value of the natural frequencies of all chips 140.

The right side of the expression (4) is the square sum of the difference between the average value of the median values of all chips 140 and the median value of each chip 140. This square sum of the difference represents variation in the median values of the natural frequencies of all chips 140.

The recording head 1 manufactured by the manufacturing method of the present embodiment includes the chips 140 which are classified into ranks by using the mode value as a reference and selected based on the ranks. Accordingly, as represented in the expression (1), variation in the mode values of the natural frequencies of all chips 140 is smaller than variation in the average values of the natural frequencies of all chips 140. In the example illustrated in FIG. 8, the mode values fa_mode_i (i is 1 to 4) of the natural frequencies of the chips #1 to #4 are the same as each other and thus, variation in the mode values is zero. On the other hand, it is clear that variation in the average values of the natural frequencies of the chips #1 to #4 is larger than zero and thus, the expression (1) is satisfied.

Similarly, also, in the expression (2) to expression (4), variation in the mode values of the natural frequencies of all chips 140 is smaller than variation in the maximum values, variation in the minimum values, and variation in the median values of the natural frequencies of all chips 140 and the expression (2) to expression (4) are satisfied.

According to the recording head 1 of the present embodiment as described above, in the recording head 1, variation in the mode values of the natural frequencies of all chips 140 is smaller than variation in the average values, variation in the maximum values, variation in the minimum value, and variation in the median values of the natural frequencies of all chips 140. It is possible to suppress variation in the ejection characteristics of ink of each segment in the recording head 1 described above and to perform high-quality printing by the recording head 1.

In the recording head 1 of the present embodiment, the number of segments using the corrected dot generation amount table is reduced. That is, it is possible to reduce the number of segments, which are targeted for correction to reduce the number of generated-dots and thus, high-quality printing can be performed.

Furthermore, in the recording head 1 of the present embodiment, the number of segments which become targets for correction of the dot generation amount table is reduced and thus, it is possible to reduce the computation time for image processing relating to image processing using the dot generation amount table.

Embodiment 2

In Embodiment 1, the natural frequency of the segment is used in order to rank the chips 140, but is not limited thereto and an ink weight (Iw) of ink ejected from the segment may be used.

A manufacturing method of the recording head 1 of the present embodiment will be described.

First, a plurality of chips 140 are manufactured. The recording head is in a state where ink can be ejected from chip 140. For example, detachable passage members are attached to the plurality of chips 140. Furthermore, detachable wring substrates are attached to the plurality of chips 140. Ink is supplied to the chips 140 through the passage members and the head control signal and the driving signal are transmitted to the plurality of chips 140 through the wring substrates so as to make it possible to eject ink.

Next, a weight of ink ejected from the segment 200 included in the chip 140 is measured for the plurality of chips 140 manufactured. Hereinafter, the weight of ink ejected from the segment 200 is simply referred to as an ink weight of the segment 200.

The ink weight of the segment 200 can be measured by a well-known device and method. For example, a specific driving waveform (driving waveform serving as a reference) capable of causing liquid droplets to be discharged is applied to the piezoelectric actuator 300 of the segment 200 so as to cause a fixed number of liquid droplets to be discharge to a receiving container. Weight variation of the receiving container or weight variation of an ink supply source such as an ink cartridge is measured so as to make it possible to measure the ink weight of the segment 200. A highly accurate gravimeter such as an electronic balance can be used for the present measurement. The segments 200 targeted for ink weight measurement may be all segments 200 included in the chip 140 or may be a plurality of arbitrarily selected segments 200. In the present embodiment, it is regarded that one hundred segments 200 are present in each chip 140 and the ink weight is measured for one hundred segments 200.

Next, the chips 140 are ranked using the mode value of the ink weight of the chip 140 as a reference. The mode value of the ink weight of the chip 140 is a value, which appears most frequently, among the ink weights obtained by measuring respective segments 200 for a single chip 140. Classifying the chips 140 into ranks by using the mode value of the ink weight as a reference refers to matters that the chips 140 of which the mode values of the ink weights are the same or fall within a predetermined range have the same rank.

Figure 13:
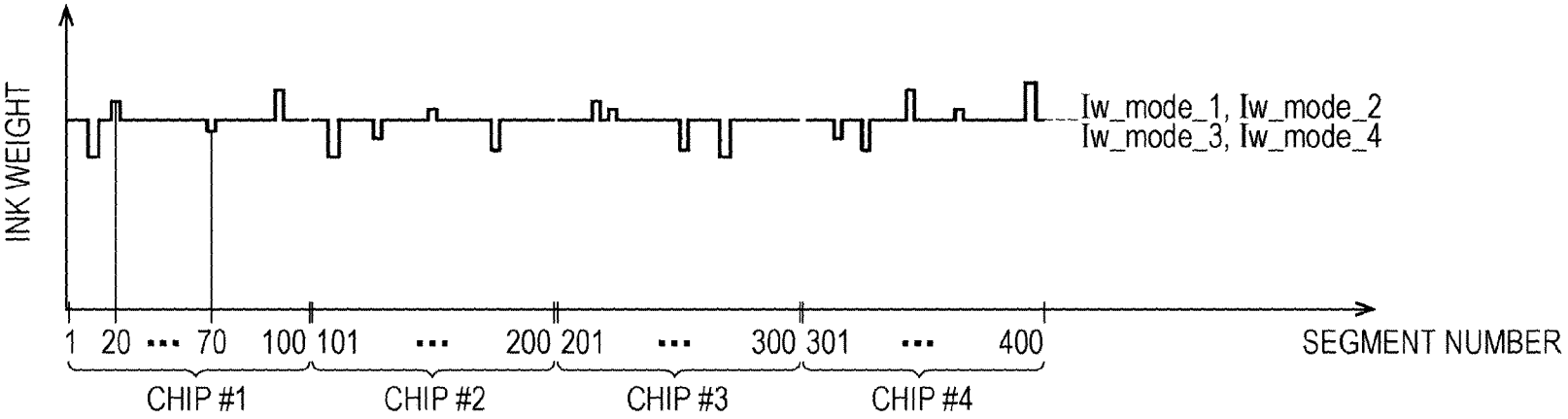
FIG. 13 is a diagram illustrating an example of rank according to Embodiment 2.

An example of rank classification is illustrated in FIG. 13. The horizontal axis represents the segment number given to the segments 200 of each chip and the vertical axis represents the ink weight. In FIG. 13, the ink weights measured for respective segments #1 to #400 of respective chips #1 to #4 are illustrated. The mode value among the ink weights of respective segments #1 to #100 included in the chip #1 is regarded as the mode value Iw_mode_1 of the ink weight of the chip #1. Similarly, the mode values of the ink weights of the chips #2 to #4 are regarded as the mode values Iw_mode_2 to Iw_mode_4, respectively. In the present embodiment, the Iw_mode_1 to Iw_mode_4 are the same value.

The chips are ranked based on the mode value described above. For example, the chips having the same mode value are regarded as the same rank. Accordingly, the chips #1 to #4 are classified into the same rank having the same mode value of the ink weight and a chip (not illustrated) having an ink weight different from the mode value is classified into another rank.

Also, an aspect of classification of the chips into ranks based on the mode value does not need to be performed according to whether the ranks are same or not. For example, a range of an ink weight may be defined for each rank, a range in which the mode value of the ink weight is included may be specified for each chip, and the chip may be ranked as a rank corresponding to the range. Although not particularly illustrated, in the aspect illustrated in FIG. 9 of Embodiment 1, the plurality of ranges of the ink weight may be determined and the range in which the mode value of the ink weight is included may be specified so as to rank the chips.

A way of taking a range is not particularly limited. As described in Embodiment 1, variation in the ink weight can be suppressed by correcting print data. However, there is a limit to the range within which print data can be corrected. Accordingly, in a case where the range of the ink weight is defined for each rank, it is preferable to define a range within which variation in the ink weights can be suppressed by correcting print data and to rank the chips based on the defined range.

After rank classification, the passage members, the wring substrates, and the like are removed from each chip 140. The recording head 1 is manufactured by using the chip 140 selected based on rank classification. The chip 140 selected based on ranks is, for example, the chip 140 classified into the same rank, and in the examples of FIG. 15, the chips #1 to #4 correspond to the chips 140 classified into the same rank. Also, the recording head 1 may be manufactured by using the chip 140 in such a way that, for example, two (or a plurality of) consecutive ranks are selected and the chips 140 classified into the ranks are used without being limited to the case where the chips 140 having the same rank are selected.

The dot generation amount table of the recording head 1 including the chip 140 selected based on ranks is prepared as follows.

Figure 14A:
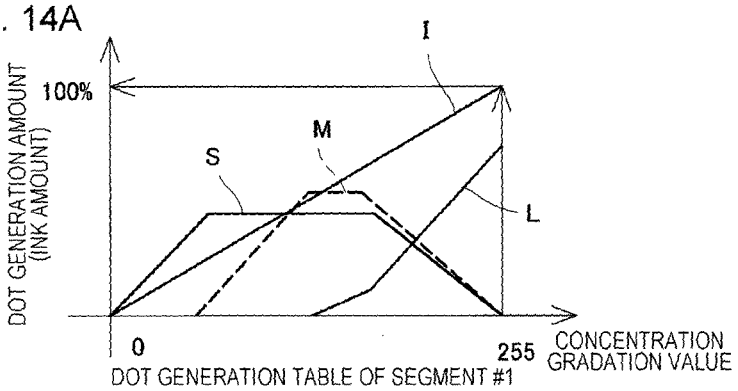
FIGS. 14A, 14B, and 14C are graphs illustrating a dot generation amount table according to Embodiment 2.
Figure 14B:
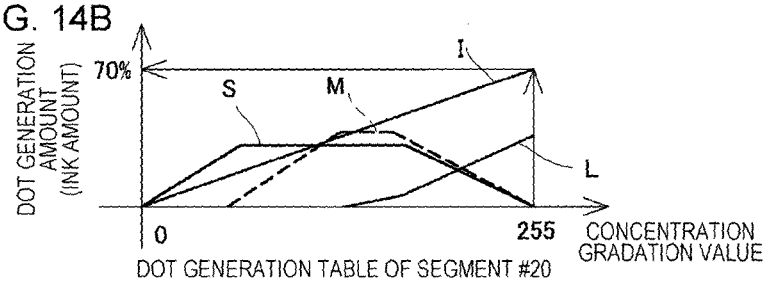
Figure 14C:
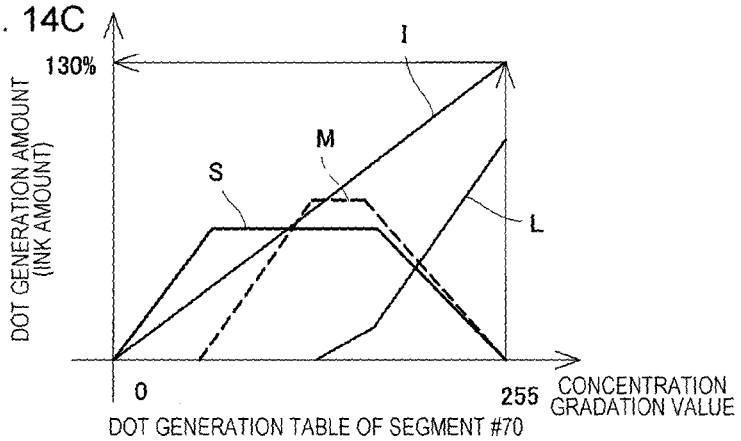

FIGS. 14A, 14B, and 14C are graphs illustrating the dot generation amount table in a graph form. The horizontal axis and the vertical axis of FIGS. 14A, 14B, and 14C are the same as those of FIG. 7. FIG. 14A is a dot generation amount table for a segment (for example, segment #1), of which the ink weight is the mode value (Iw_mode_1), among the segments of the chip #1 illustrated in FIG. 13. FIG. 14B is a dot generation amount table for a segment (for example, segment #20), of which the ink weight is larger than the mode value (Iw_mode_1), among the segments of the chip #1 illustrated in FIG. 13. FIG. 14C is a dot generation amount table for a segment (for example, segment #70), of which the ink weight is smaller than the mode value (Iw_mode_1), among the segments of the chip #1 illustrated in FIG. 13.

First, as illustrated in FIG. 14A, a dot generation amount table is prepared for the segment #1 of which the ink weight is the mode value.

In each segment, variation in the ink weight is present due to difference in the natural frequencies described in Embodiment 1. For that reason, even when the segment is controlled to eject the same ink weight, the ink weight of dots actually ejected from the segment #20 becomes larger than the ink weight of dots actually ejected from the segment #1.

For that reason, even when the same concentration gradation value is taken, the segment #20 which ejects ink of which the weight is large is corrected so that the ink weight becomes small.

For example, as illustrated in FIG. 14B, the dot generation amount table of the segment #20 is prepared by performing correction to reduce the dot generation amount by using the dot generation amount table of the segment #1 of which the ink weight is the mode value as a reference. Here, the ink weight of the segment #1 illustrated in FIG. 14A is corrected to become 70% thereof to be set as the ink weight of the segment #20. An amount to be corrected is suitably determined based on the difference between the ink weight of the segment #20 and the mode value.

For that reason, even when the same concentration gradation value is taken, the segment #70, which ejects ink of which the weight is small, that is, the segment #70 of which the ink weight is smaller than the mode value, is corrected so that the ink weight becomes large.

For example, as illustrated in FIG. 14C, the dot generation amount table of the segment #70 is prepared by performing correction to increase the dot generation amount by using the dot generation amount table of the segment #1 of which the ink weight is the mode value as a reference. Here, the ink weight of the segment #1 illustrated in FIG. 14A is corrected to become 130% thereof to be set as the ink weight of the segment #70. An amount to be corrected is suitably determined based on the difference between the natural frequency of the segment #70 and the mode value.

In a case where the dot generation amount tables illustrated in FIGS. 14A, 14B, and 14C are used, even when the same concentration gradation value is taken, the ink weight is different among the segment #1, the segment #20, and the segment #70. However, when ink is actually ejected using the head control signal based on the ink weight, there is no actual difference in the ink weight between the segments and dots of which variation is suppressed can be formed. That is, it is possible to suppress variation in the ink weight between the segments.

Also, regarding a segment other than the segment #1, the segment #20, and segment #70, similarly, the dot generation amount table is prepared based on the difference between the ink weight of each segment and the mode value and is stored in the storing unit 212.

According to the manufacturing method of the present embodiment as described above, the recording head 1 is manufactured by classifying the chips 140 into ranks using the mode value of the ink weight of the segment 200 as a reference and by selecting the chip 140 based on the ranks. With this, it is possible to manufacture the recording head 1 including the plurality of chips 140 in which variation in ink ejection characteristics of respective segments is suppressed.

According to the manufacturing method of the present embodiment, it is possible to manufacture the recording head 1 in which the mode value values of the ink weights of the chips 140 (chips #1 to #4) belong to the same rank. With this, it is possible to reduce a correction amount of the dot generation amount table which becomes a reference. In the example of FIG. 13, most of the segments of the chips #1 to #4 are aligned in the mode value and thus, the dot generation amount tables for these segments do not need to be corrected. In other words, the dot generation amount table may be corrected for only the segment of which the ink weight is larger than the mode value. As such, according to the manufacturing method of the present embodiment, it is possible to reduce the number of segments which become targets for correction of the dot generation amount table.

Furthermore, according to the manufacturing method of the present embodiment, it is possible to reduce the number of the segments which become targets for correction of the dot generation amount table and thus, it is possible to reduce the computation time for image processing using the dot generation amount table.

In the recording head 1 manufactured by the manufacturing method of the present embodiment, the ink weight of the segment 200 of the chip 140 satisfies the following expression.

$$\sum_{i=1}^{n}(\text{Iw_mode_i} - \text{Iw_mode_ave})^2 < \sum_{i=1}^{n}(\text{Iw_ave_i} - \text{Iw_ave_ave})^2 \tag{5}$$

$$\sum_{i=1}^{n}(\text{Iw_mode_i} - \text{Iw_mode_ave})^2 < \sum_{i=1}^{n}(\text{Iw_max_i} - \text{Iw_max_ave})^2 \tag{6}$$

$$\sum_{i=1}^{n}(\text{Iw_mode_i} - \text{Iw_mode_ave})^2 < \sum_{i=1}^{n}(\text{Iw_min_i} - \text{Iw_min_ave})^2 \tag{7}$$

$$\sum_{i=1}^{n}(\text{Iw_mode_i} - \text{Iw_mode_ave})^2 < \sum_{i=1}^{n}(\text{Iw_med_i} - \text{Iw_med_ave})^2 \tag{8}$$

$$\text{Iw_mode_ave} = \left(\sum_{i=1}^{n}\text{Iw_mode_i}\right)\Big/ n$$

$$\text{Iw_ave_ave} = \left(\sum_{i=1}^{n}\text{Iw_ave_i}\right)\Big/ n$$

$$\text{Iw_max_ave} = \left(\sum_{i=1}^{n}\text{Iw_max_i}\right)\Big/ n$$

$$\text{Iw_min_ave} = \left(\sum_{i=1}^{n}\text{Iw_min_i}\right)\Big/ n$$

$$\text{Iw_med_ave} = \left(\sum_{i=1}^{n}\text{Iw_med_i}\right)\Big/ n$$

Here, i is an integer from 1 to n, n is the number of chips 140 included in the recording head 1, and Iw_mode_i is the mode value of the ink weights of a plurality of segments 200 included in an i-th chip 140.

Iw_ave_i is the average value of the ink weights of the plurality of segments 200 included in the i-th chip 140.

Iw_max_i is the maximum value of the ink weights of the plurality of segments 200 included in the i-th chip 140.

Iw_min_i is the minimum value of the ink weights of the plurality of segments 200 included in the i-th chip 140.

Iw_med_i is the median value of the ink weights of the plurality of segments 200 included in the i-th chip 140.

The mode value, the average value, the maximum value, the minimum value, and the median value may be obtained from the ink weights of all segments included in the i-th chip 140 and may be obtained from the ink weights of arbitrary number of segments 200.

Each of left sides of the expression (5) to expression (8) is the square sum of the difference between the average value of the mode values of all chips 140 and the mode value of each chip 140. This square sum of the difference represents variation in the mode values of the ink weights of all chips 140.

The right side of the expression (5) is the square sum of the difference between the average value of the average values of all chips 140 and the average value of each chip 140. This square sum of the difference represents variation in the average values of the ink weights of all chips 140.

The right side of the expression (6) is the square sum of the difference between the average value of the maximum values of all chips 140 and the maximum value of each chip 140. This square sum of the difference represents variation in the maximum values of the ink weights of all chips 140.

The right side of the expression (7) is the square sum of the difference between the average value of the minimum values of all chips 140 and the minimum value of each chip 140. This square sum of the difference represents variation in the minimum values of the ink weights of all chips 140.

The right side of the expression (8) is the square sum of the difference between the average value of the median values of all chips 140 and the median value of each chip 140. This square sum of the difference represents variation in the median values of the ink weights of all chips 140.

The recording head 1 manufactured by the manufacturing method of the present embodiment includes the chips 140 which are classified into ranks by using the mode value of the ink weight as a reference and selected based on the ranks. Accordingly, as represented in the expression (5), variation in the mode values of the ink weights of all chips 140 is smaller than variation in the average values of the ink weights of all chips 140. In the example illustrated in FIG. 15, the mode values Iw_mode_i (i is 1 to 4) of the ink weights of the chips #1 to #4 are the same as each other and thus, variation in the mode values is zero. On the other hand, it is clear that variation in the average values of the ink weights of the chips #1 to #4 is larger than zero and thus, the expression (5) is satisfied.

Similarly, also, in the expression (6) to expression (8), variation in the mode values of the ink weights of all chips 140 is smaller than variation in the maximum values, variation in the minimum values, and variation in the median values of the ink weights of all chips 140 and the expression (6) to expression (8) are satisfied.

According to the recording head 1 of the present embodiment as described above, in the recording head 1, variation in the mode values of the ink weight of all chips 140 is smaller than variation in the average values, variation in the maximum value, variation in the minimum value, and variation in the median values of the ink weight of all chips 140. It is possible to suppress variation in the ejection characteristics of ink of each segment in the recording head 1 described above and to perform high-quality printing by the recording head 1.

Furthermore, in the recording head 1 of the present embodiment, the number of segments which become targets for correction of the dot generation amount table can be reduced and thus, it is possible to reduce the computation time for image processing relating to the dot generation amount table.

Embodiment 3

In Embodiment 1, the natural frequency of the segment is used in order to rank the chips 140, but is not limited thereto and a segment displacement amount (D) may be used.

A manufacturing method of the recording head 1 of the present embodiment will be described. First, a plurality of chips 140 are manufactured. The recording head is in a state where the diaphragm 50 of each chip 140 can be displaced. For example, detachable wring substrates are attached to the plurality of chips 140. The head control signal and the driving signal are transmitted to the plurality of chips 140 through the wring substrates so as to make it possible to operate the piezoelectric actuator 300 and displace the diaphragm.

Next, a displacement amount of the diaphragm 50 of the segment 200 included in the chip 140 is measured. Hereinafter, the displacement amount of the diaphragm 50 of the segment 200 is simply referred to as a segment displacement amount.

The displacement amount of the segment 200 can be measured by a well-known device and method. For example, the displacement amount can be measured using a Doppler vibrometer. The measurement is performed in such a way that difference in wavelengths occurs in a reciprocating path of laser due to reflection of laser from a moving object (diaphragm 50 of segment 200) and speeds of the diaphragm 50 of the segment 200 is measured by using the Doppler effect. The speeds of the diaphragm 50 are integrated so as to make it possible to measure the displacement amount of the diaphragm 50. The segments 200 targeted for displacement amount measurement may be all segments 200 included in the chip 140 or may be a plurality of arbitrarily selected segments 200. In the present embodiment, it is regarded that one hundred segments 200 are present in each chip 140 and the displacement amount is measured for one hundred segments 200.

Next, the chips 140 are ranked using the mode value of the displacement amount of the chip 140 as a reference. The mode value of the displacement amount of the chip 140 refers to a value, which appears most frequently, among the displacement amounts obtained by measuring respective segments 200 for a single chip 140. Classifying the chips 140 into ranks by using the mode value of the displacement amount as a reference refers to matters that the chips 140 of which the mode values of the displacement amounts are the same or fall within a predetermined range have the same rank.

Figure 15:
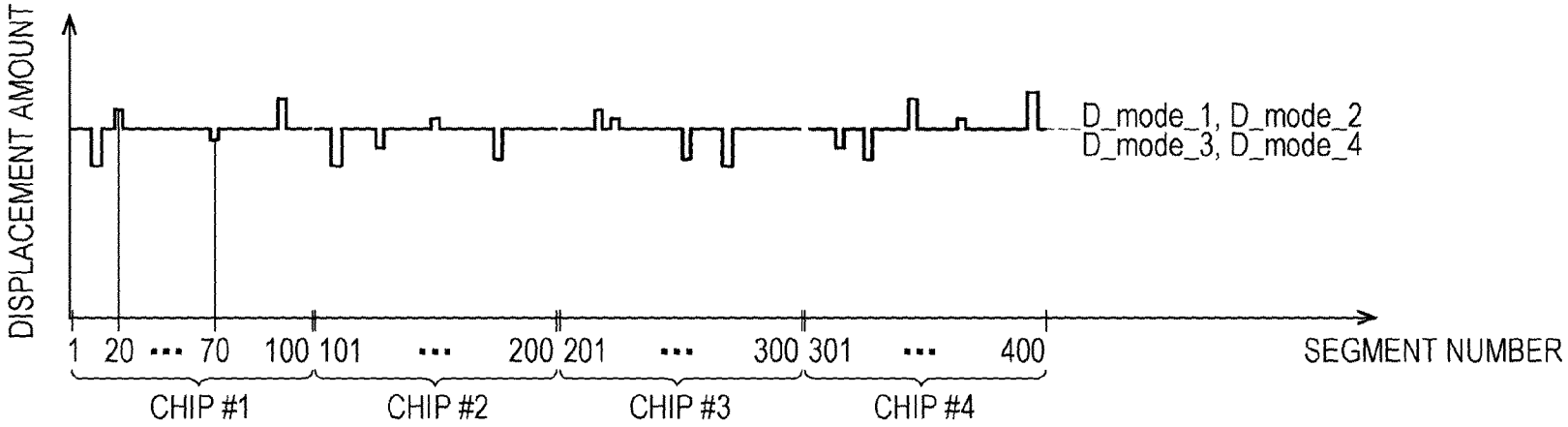
FIG. 15 is a diagram illustrating an example of rank according to Embodiment 3.

An example of rank classification is illustrated in FIG. 15. The horizontal axis represents the segment number given to the segments 200 of each chip and the vertical axis represents the displacement amount. In FIG. 15, the displacement amounts measured for respective segments #1 to #400 of respective chips #1 to #4 are illustrated. The mode value among the displacement amounts of respective segments #1 to #100 included in the chip #1 is regarded as the mode value D_mode_1 of the displacement amount of the chip #1. Similarly, the mode values of the displacement amounts of the chips #2 to #4 are regarded as the mode values D_mode_2 to D_mode_4, respectively. In the present embodiment, the D_mode_1 to D_mode_4 are the same value.

The chips are ranked based on the mode value described above. For example, the chips having the same mode value are regarded as the same rank. Accordingly, the chips #1 to #4 are classified into the same rank having the same mode value of the displacement amount and a chip (not illustrated) having a displacement amount different from the mode value is classified into another rank.

Also, an aspect of classification of the chips into ranks based on the mode value does not need to be performed according to whether the ranks are the same or not. For example, a range of a displacement amount may be defined for each rank, a range in which the mode value of the displacement amount is included may be specified for each chip, and the chip may be ranked as a rank corresponding to the range. Although not particularly illustrated, in the aspect illustrated in FIG. 9 of Embodiment 1, the plurality of ranges of the displacement amount may be determined and the range in which the maximum value of the displacement amount is included may be specified so as to rank the chips.

Here, each segment displacement amount has correlation with the weight of ink ejected from each segment. Accordingly, when the same driving signal is given to respective segments to cause ink to be discharged, variation also occurs in the ink weights ejected from respective segments due to variation in the displacement amount. Variation in the ink weight due to variation in the displacement amount described above can be suppressed by correcting print data described above. However, there is a limit to the range within which print data can be corrected.

Accordingly, in a case where a range of the displacement amount is defined for each rank, it is preferable to define a range within which variation in the ink weights can be suppressed by correcting print data and to rank the chips based on the range of the displacement amount corresponding to the defined range.

After rank classification, the wring substrates and the like are removed from each chip 140. The recording head 1 is manufactured by using the chip 140 selected based on rank classification. The chip 140 selected based on ranks is, for example, the chip 140 classified into the same rank, and in the examples of FIG. 15, the chips #1 to #4 correspond to the chips 140 classified into the same rank. Also, the recording head 1 may be manufactured by using the chip 140 in such a way that, for example, two (or a plurality of) consecutive ranks are selected and the chips 140 classified into the ranks are used without being limited to the case where the chips 140 having the same rank are selected.

The dot generation amount table of the recording head 1 including the chip 140 selected based on ranks is prepared as follows.

Figure 16A:
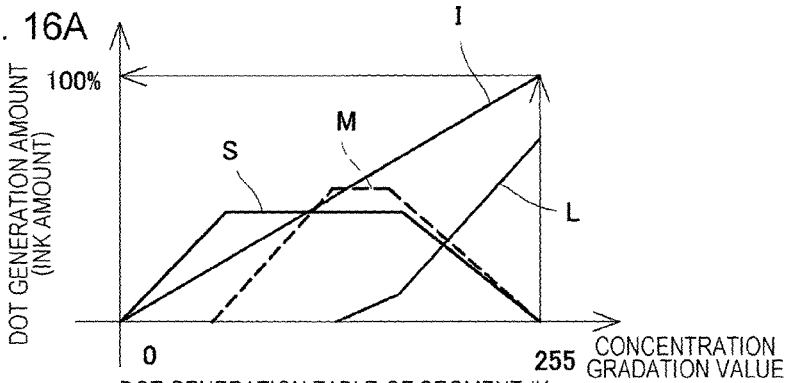
FIGS. 16A, 16B, and 16C are graphs illustrating a dot generation amount table according to Embodiment 3.
Figure 16B:
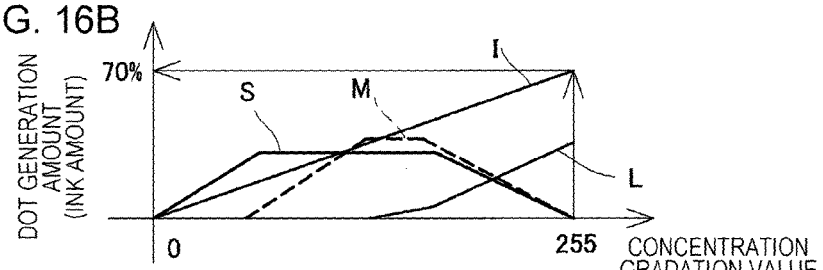
Figure 16C:
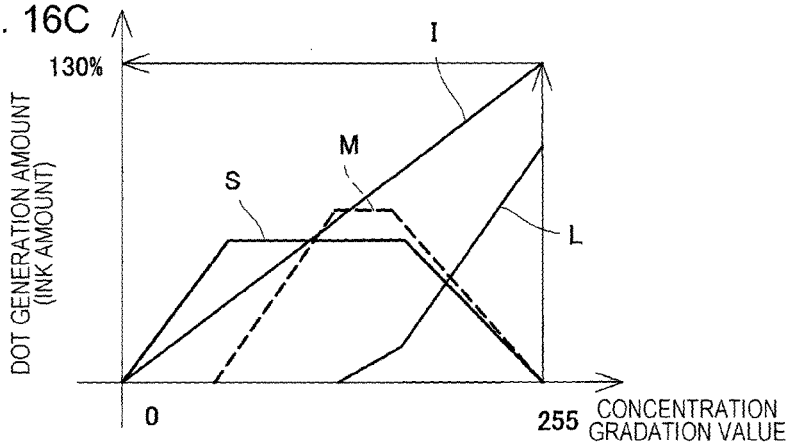

FIGS. 16A, 16B, and 16C are graphs illustrating the dot generation amount table in a graph form. The horizontal axis and the vertical axis of FIGS. 16A, 16B, and 16C are the same as those of FIG. 7. FIG. 16A is a dot generation amount table for a segment (for example, segment #1), of which the displacement amount is the mode value (D_mode_1), among the segments of the chip #1 illustrated in FIG. 15. FIG. 16B is a dot generation amount table for a segment (for example, segment #20), of which the displacement amount is larger than the mode value (D_mode_1), among the segments of the chip #1 illustrated in FIG. 15. FIG. 16C is a dot generation amount table for a segment (for example, segment #70), of which the displacement amount is smaller than the mode value (D_mode_1), among the segments of the chip #1 illustrated in FIG. 15.

First, as illustrated in FIG. 16A, a dot generation amount table is prepared for the segment #1 of which the displacement amount is the mode value.

The segment displacement amount has correlation with the weight of ink ejected from each segment and the weight of ink having a large displacement amount is large. For that reason, even when the segment is controlled to eject the same ink weight, the ink weight of dots actually ejected from the segment #20 becomes larger than the ink weight of dots actually ejected from the segment #1.

For that reason, even when the same concentration gradation value is taken, the segment #20 which ejects ink of which the weight is large, that is, the segment #20 of which the displacement amount is larger than the mode value is corrected so that the ink weight becomes small.

For example, as illustrated in FIG. 16B, the dot generation amount table of the segment #20 is prepared by performing correction to reduce the dot generation amount by using the dot generation amount table of the segment #1 of which the displacement amount is the mode value as a reference. Here, the ink weight of the segment #1 illustrated in FIG. 16A is corrected to become 70% thereof to be set as the ink weight of the segment #20. An amount to be corrected is suitably determined based on the difference between the displacement amount of the segment #20 and the mode value.

Also, even when the same concentration gradation value is taken, the segment #70, which ejects ink of which the weight is small, that is, the segment #70 of which the natural frequency is larger than the mode value, is corrected so that the ink weight becomes large.

As illustrated in FIG. 16C, the dot generation amount table of the segment #70 is prepared by performing correction to increase the dot generation amount by using the dot generation amount table of the segment #1 of which the displacement amount is the mode value as a reference. Here, the ink weight of the segment #1 illustrated in FIG. 16A is corrected to become 130% thereof to be set as the ink weight of the segment #70. An amount to be corrected is suitably determined based on the difference between the displacement amount of the segment #70 and the mode value.

In a case where the dot generation amount tables illustrated in FIGS. 16A, 16B, and 16C are used, even when the same concentration gradation value is taken, the ink weight is different among the segment #1, the segment #20, and the segment #70. However, when ink is actually ejected using the head control signal based on the ink weight, there is no actual difference in the ink weight between the segments and dots of which variation is suppressed can be formed. That is, it is possible to suppress variation in the ink weight between the segments, which are caused by the difference between the displacement amount.

Also, regarding a segment other than the segment #1 and the segment #20, similarly, the dot generation amount table is prepared based on the difference between the displacement amounts and is stored in the storing unit 212.

According to the manufacturing method of the present embodiment as described above, the recording head 1 is manufactured by classifying the chips 140 into ranks using the mode value of the displacement amount of the segment 200 as a reference and by selecting the chip 140 based on the ranks. With this, it is possible to manufacture the recording head 1 including the plurality of chips 140 in which variation in ink ejection characteristics of respective segments is suppressed.

According to the manufacturing method of the present embodiment, it is possible to manufacture the recording head 1 in which the mode values of the displacement amounts of the chips 140 (chips #1 to #4) belong to the same rank. With this, it is possible to reduce a correction amount of the dot generation amount table which becomes a reference. In the example of FIG. 15, most of the segments of the chips #1 to #4 are aligned in the mode value and thus, the dot generation amount tables for these segments do not need to be corrected. In other words, the dot generation amount table may be corrected for only the segment of which the displacement amount is smaller than or larger than the mode value. As such, according to the manufacturing method of the present embodiment, it is possible to reduce the number of segments which become targets for correction of the dot generation amount table.

Furthermore, according to the manufacturing method of the present embodiment, it is possible to reduce the number of the segments which become targets for correction of the dot generation amount table and thus, it is possible to reduce the computation time for image processing using the dot generation amount table.

Furthermore, according to the manufacturing method of the present embodiment, correction of the dot generation amount table is performed for the segment of which the displacement amount is larger than the mode value based on the difference between the displacement amount of the segment and the mode value of the displacement amount. As such, according to the manufacturing method of the present embodiment, it is possible to correct the dot generation amount table without causing ink to be ejected from the recording head 1.

In the recording head 1 manufactured by the manufacturing method of the present embodiment, the displacement amount of the segment 200 of the chip 140 satisfies the following expression.

$$\sum_{i=1}^{n}(\text{D_mode_i}-\text{D_mode_ave})^2<\sum_{i=1}^{n}(\text{D_ave_i}-\text{D_ave_ave})^2 \tag{9}$$

$$\sum_{i=1}^{n}(\text{D_mode_i}-\text{D_mode_ave})^2<\sum_{i=1}^{n}(\text{D_max_i}-\text{D_max_ave})^2 \tag{10}$$

$$\sum_{i=1}^{n}(\text{D_mode_i}-\text{D_mode_ave})^2<\sum_{i=1}^{n}(\text{D_min_i}-\text{D_min_ave})^2 \tag{11}$$

$$\sum_{i=1}^{n}(\text{D_mode_i}-\text{D_mode_ave})^2<\sum_{i=1}^{n}(\text{D_med_i}-\text{D_med_ave})^2 \tag{12}$$

$$\text{D_mode_ave}=\left(\sum_{i=1}^{n}\text{D_mode_i}\right)\Big/n$$

$$\text{D_ave_ave}=\left(\sum_{i=1}^{n}\text{D_ave_i}\right)\Big/n$$

$$\text{D_max_ave}=\left(\sum_{i=1}^{n}\text{D_max_i}\right)\Big/n$$

$$\text{D_min_ave}=\left(\sum_{i=1}^{n}\text{D_min_i}\right)\Big/n$$

$$\text{D_med_ave}=\left(\sum_{i=1}^{n}\text{D_med_i}\right)\Big/n$$

Here, i is an integer from 1 to n, n is the number of chips 140 included in the recording head 1, and D_mode_i is the mode value of the displacement amounts of a plurality of segments 200 included in an i-th chip 140.

D_ave_i is the average value of the displacement amounts of the plurality of segments 200 included in the i-th chip 140.

D_max_i is the maximum value of the displacement amounts of the plurality of segments 200 included in the i-th chip 140.

D_min_i is the minimum value of the displacement amounts of the plurality of segments 200 included in the i-th chip 140.

D_med_i is the median value of the displacement amounts of the plurality of segments 200 included in the i-th chip 140.

The mode value, the average value, the maximum value, the minimum value, and the median value may be obtained from the displacement amounts of all segments included in the i-th chip 140 and may be obtained from the displacement amounts of arbitrary number of segments 200.

Each of left sides of the expression (9) to expression (12) is the square sum of the difference between the average value of the mode values of all chips 140 and the mode value of each chip 140. This square sum of the difference represents variation in the mode values of the displacement amounts of all chips 140.

The right side of the expression (9) is the square sum of the difference between the average value of the average values of all chips 140 and the average value of each chip 140. This square sum of the difference represents variation in the average values of the displacement amounts of all chips 140.

The right side of the expression (10) is the square sum of the difference between the average value of the maximum values of all chips 140 and the maximum value of each chip 140. This square sum of the difference represents variation in the maximum values of the displacement amounts of all chips 140.

The right side of the expression (11) is the square sum of the difference between the average value of the minimum values of all chips 140 and the minimum value of each chip 140. This square sum of the difference represents variation in the minimum values of the displacement amounts of all chips 140.

The right side of the expression (12) is the square sum of the difference between the average value of the median values of all chips 140 and the median value of each chip 140. This square sum of the difference represents variation in the median values of the displacement amounts of all chips 140.

The recording head 1 manufactured by the manufacturing method of the present embodiment includes the chips 140 which are classified into ranks by using the mode value as a reference and selected based on the ranks. Accordingly, as represented in the expression (9), variation in the mode values of the displacement amounts of all chips 140 is smaller than variation in the average values of the displacement amounts of all chips 140. In the example illustrated in FIG. 15, the mode values D_mode_i (i is 1 to 4) of the displacement amounts of the chips #1 to #4 are the same as each other and thus, variation in the mode values is zero. On the other hand, it is clear that variation in the average values of the displacement amounts of the chips #1 to #4 is larger than zero and thus, the expression (9) is satisfied.

Similarly, also, in the expression (10) to expression (12), variation in the mode values of the displacement amounts of all chips 140 is smaller than variation in the maximum values, variation in the minimum values, and variation in the median values of the displacement amounts of all chips 140 and the expression (10) to expression (12) are satisfied.

According to the recording head 1 of the present embodiment as described above, in the recording head 1, variation in the mode values of the displacement amounts of all chips 140 is smaller than variation in the average values, variation in the maximum value, variation in the minimum value, and variation in the median values of the displacement amounts of all chips 140. It is possible to suppress variation in the ejection characteristics of ink of each segment in the recording head 1 described above and to perform high-quality printing by the recording head 1.

Furthermore, in the recording head 1 of the present embodiment, the number of segments which become targets for correction of the dot generation amount table can be reduced and thus, it is possible to reduce the computation time for image processing using the dot generation amount table.

OTHER EMBODIMENTS

Although respective embodiments of the invention are described, basic configurations of the invention are not limited to matters described above.

In the recording head 1 of Embodiment 1 and Embodiment 2, the piezoelectric actuator 300 is illustrated as the pressure generating unit causing a pressure change the pressure generating chamber 12, but is not limited thereto. As the pressure generating unit causing a pressure change the pressure generating chamber 12, for example, a thick film-type piezoelectric actuator formed by a method of pasting a green sheet, or the like, and longitudinal vibration-type piezoelectric actuator in which a piezoelectric material and an electrode formation material are alternately laminated and extended and contracted in the axis direction can be used. As the pressure generating unit, the so-called electrostatic actuator, in which a heating element is disposed in the pressure generating chamber and discharge of liquid droplets from the nozzle opening is caused by bubbles generated by heating of the heating element or static electricity is generated between the diaphragm and an electrode, the diaphragm is deformed by an electrostatic force, and liquid droplets are discharged from the nozzle opening, or the like can be used.

Furthermore, in the ink jet recording apparatus I described above, although an example in which the recording head 1 is mounted on the carriage 3 and is moved in the main scanning direction is illustrated, but is not particularly limited thereto. The invention may also be applied to, for example, the so-called line-type recording device in which the recording head 1 is fixed, the recording sheet S such as paper is only moved in the sub-scanning direction so as to perform printing. In the line-type recording device, the recording head 1 is mounted on the ink jet recording apparatus I so that a parallel arrangement direction of the pressure generating chambers 12 (nozzle openings 21) becomes the second direction Y. The row arrangement direction in which a plurality of rows of the pressure generating chambers 12 are arranged coincides with the first direction X of the ink jet recording apparatus I.

In the embodiments described above, although the ink jet recording head is exemplified as an example of the liquid ejecting head and the ink jet recording apparatus is exemplified as an example of the liquid ejecting apparatus, the invention targets the whole range of the liquid ejecting head and the liquid ejecting apparatus and also can be applied the liquid ejecting head and the liquid ejecting apparatus ejecting liquid other than ink. As other liquid ejecting heads, for example, various recording heads used for an image recording device such as a printer, a color material ejection head used for manufacturing a color filter such as a liquid crystal display, an electrode material ejection head used for forming an electrode of an organic EL display, a field emission display (FED), or the like, a bio-organic material ejection head used for manufacturing a bio chip may be included.

What is claimed is:

1. A method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method comprising:

measuring respective values of natural frequencies of the plurality of segments included in each of the chips;

determining a mode value of each of the chips by analyzing statistically the measured respective values of the natural frequencies;

classifying the chips into ranks using the mode value; and manufacturing the liquid ejecting head which includes the chips selected based on the ranks, wherein a corresponding mode value for any corresponding one of the chips is a value that appears most frequently among the respective values of the natural frequencies in the corresponding one chip.

2. The method for manufacturing a liquid ejecting head according to claim 1, wherein a range of the natural frequencies is defined for each rank to classify the chips into a rank corresponding to the range.

3. The method for manufacturing a liquid ejecting head according to claim 2, wherein the range of the natural frequencies is set to a range that divisions of which the number is greater than or equal to 10 and less than or equal to 50 are made between the minimum value and the maximum value of the mode value of the natural frequencies.

4. The method for manufacturing a liquid ejecting head according to claim 2, wherein the range of the natural frequencies is defined so that a weight of liquid ejected from each segment of the chip equals to an amount within ±5%.

5. A method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method comprising:

measuring respective values of weights of liquid ejected from each of the plurality of segments included in each of the chips;

determining a mode value of each of the chips by analyzing statistically the measured respective values of the weights;

classifying the chips into ranks using the mode values; and manufacturing the liquid ejecting head which includes the chips selected based on the ranks, wherein a corresponding mode value for any corresponding one of the chips is a value that appears most frequently among the respective values of the weights in the corresponding one chip.

6. A method for manufacturing a liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, the method comprising:

measuring respective values of displacements of the diaphragms of the plurality of segments included in each of the chips;

determining a mode value of each of the chips by analyzing statistically the measured respective values of the displacements;

classifying the chips into ranks using the mode values; and manufacturing the liquid ejecting head which includes the chips selected based on the ranks, wherein a corresponding mode value for any corresponding one of the chips is a value that appears most frequently among the respective values of the displacements in the corresponding one chip.

7. A liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, wherein the liquid ejecting head satisfies the following expression, $$\sum_{i=1}^{n}(\text{fa_mode_i} - \text{fa_mode_ave})^2 < \sum_{i=1}^{n}(\text{fa_ave_i} - \text{fa_ave_ave})^2$$

$$\sum_{i=1}^{n}(\text{fa_mode_i} - \text{fa_mode_ave})^2 < \sum_{i=1}^{n}(\text{fa_max_i} - \text{fa_max_ave})^2$$

$$\sum_{i=1}^{n}(\text{fa_mode_i} - \text{fa_mode_ave})^2 < \sum_{i=1}^{n}(\text{fa_min_i} - \text{fa_min_ave})^2$$

$$\sum_{i=1}^{n}(\text{fa_mode_i} - \text{fa_mode_ave})^2 < \sum_{i=1}^{n}(\text{fa_med_i} - \text{fa_med_ave})^2$$

$$\text{fa_mode_ave} = \left(\sum_{i=1}^{n}\text{fa_mode_i}\right)\Big/ n$$

$$\text{fa_ave_ave} = \left(\sum_{i=1}^{n}\text{fa_ave_i}\right)\Big/ n$$

$$\text{fa_max_ave} = \left(\sum_{i=1}^{n}\text{fa_max_i}\right)\Big/ n$$

$$\text{fa_min_ave} = \left(\sum_{i=1}^{n}\text{fa_min_i}\right)\Big/ n$$

$$\text{fa_med_ave} = \left(\sum_{i=1}^{n}\text{fa_med_i}\right)\Big/ n$$

where i is an integer from 1 to n, n is the number of chips included in the liquid ejecting head, and fa_mode_i, fa_ave_i, fa_max_i, fa_min_i, and fa_med_i correspond to the mode value, the average value, the maximum value, the minimum value, and the median value of natural frequencies of a plurality of segments included in an i-th chip.

8. A liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, wherein the liquid ejecting head satisfies the following expression, $$\sum_{i=1}^{n}(\text{Iw_mode_i}-\text{Iw_mode_ave})^2<\sum_{i=1}^{n}(\text{Iw_ave_i}-\text{Iw_ave_ave})^2$$

$$\sum_{i=1}^{n}(\text{Iw_mode_i}-\text{Iw_mode_ave})^2<\sum_{i=1}^{n}(\text{Iw_max_i}-\text{Iw_max_ave})^2$$

$$\sum_{i=1}^{n}(\text{Iw_mode_i}-\text{Iw_mode_ave})^2<\sum_{i=1}^{n}(\text{Iw_min_i}-\text{Iw_min_ave})^2$$

$$\sum_{i=1}^{n}(\text{Iw_mode_i}-\text{Iw_mode_ave})^2<\sum_{i=1}^{n}(\text{Iw_med_i}-\text{Iw_med_ave})^2$$

$$\text{Iw_mode_ave}=\left(\sum_{i=1}^{n}\text{Iw_mode_i}\right)\Big/n$$

$$\text{Iw_ave_ave}=\left(\sum_{i=1}^{n}\text{Iw_ave_i}\right)\Big/n$$

$$\text{Iw_max_ave}=\left(\sum_{i=1}^{n}\text{Iw_max_i}\right)\Big/n$$

$$\text{Iw_min_ave}=\left(\sum_{i=1}^{n}\text{Iw_min_i}\right)\Big/n$$

$$\text{Iw_med_ave}=\left(\sum_{i=1}^{n}\text{Iw_med_i}\right)\Big/n$$

where i is an integer from 1 to n, n is the number of chips included in the liquid ejecting head, and Iw_mode_i, Iw_ave_i, Iw_max_i, Iw_min_i, and Iw_med_i correspond to the mode value, the average value, the maximum value, the minimum value, and the median value of the weights of liquid ejected from each of the plurality of segments included in an i-th chip.

9. A liquid ejecting head which includes a plurality of chips, each of which includes a plurality of segments, each segment including a pressure generating chamber communicating with a nozzle opening through which liquid is discharged, a diaphragm which is a portion of the pressure generating chamber, and a pressure generating unit causing a pressure change in the pressure generating chamber through the diaphragm, wherein the liquid ejecting head satisfies the following expression, $$\sum_{i=1}^{n}(\text{D_mode_i}-\text{D_mode_ave})^2<\sum_{i=1}^{n}(\text{D_ave_i}-\text{D_ave_ave})^2$$

$$\sum_{i=1}^{n}(\text{D_mode_i}-\text{D_mode_ave})^2<\sum_{i=1}^{n}(\text{D_max_i}-\text{D_max_ave})^2$$

$$\sum_{i=1}^{n}(\text{D_mode_i}-\text{D_mode_ave})^2<\sum_{i=1}^{n}(\text{D_min_i}-\text{D_min_ave})^2$$

$$\sum_{i=1}^{n}(\text{D_mode_i}-\text{D_mode_ave})^2<\sum_{i=1}^{n}(\text{D_med_i}-\text{D_med_ave})^2$$

$$\text{D_mode_ave}=\left(\sum_{i=1}^{n}\text{D_mode_i}\right)\Big/n$$

$$\text{D_ave_ave}=\left(\sum_{i=1}^{n}\text{D_ave_i}\right)\Big/n$$

$$\text{D_max_ave}=\left(\sum_{i=1}^{n}\text{D_max_i}\right)\Big/n$$

$$\text{D_min_ave}=\left(\sum_{i=1}^{n}\text{D_min_i}\right)\Big/n$$

$$\text{D_med_ave}=\left(\sum_{i=1}^{n}\text{D_med_i}\right)\Big/n$$

where i is an integer from 1 to n, n is the number of chips included in the liquid ejecting head, and D_mode_i, D_ave_i, D_max_i, D_min_i, and D_med_i correspond to the mode value, the average value, the maximum value, the minimum value, and the median value of displacement amounts of the diaphragms of the plurality of segments included in an i-th chip.

* * * * *